US012454890B2

(12) United States Patent
Patwa et al.

(10) Patent No.: US 12,454,890 B2
(45) Date of Patent: Oct. 28, 2025

(54) WELLBORE PROBE MOVEMENT CONTROL

(71) Applicant: Halliburton Energy Services, Inc., Houston, TX (US)

(72) Inventors: Ruchir Shirish Patwa, Houston, TX (US); Akshay Girish Khandekar, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 391 days.

(21) Appl. No.: 18/300,969

(22) Filed: Apr. 14, 2023

(65) Prior Publication Data

US 2024/0344455 A1 Oct. 17, 2024

(51) Int. Cl.

| | |
|---|---|
| ***E21B 49/08*** | (2006.01) |
| ***E21B 47/06*** | (2012.01) |
| ***E21B 47/09*** | (2012.01) |
| *E21B 49/10* | (2006.01) |

(52) U.S. Cl.

CPC ..... *E21B 49/082* (2013.01); *E21B 47/06* (2013.01); *E21B 47/09* (2013.01); *E21B 49/10* (2013.01)

(58) Field of Classification Search

CPC ..... E21B 47/06; E21B 47/09; E21B 49/082; E21B 49/10

See application file for complete search history.

(56) References Cited

U.S. PATENT DOCUMENTS

| | | | | |
|---|---|---|---|---|
| 5,165,274 | A | 11/1992 | Thiercelin | |
| 5,644,076 | A * | 7/1997 | Proett | E21B 49/10 175/48 |
| 7,178,392 | B2 | 2/2007 | Dhruva et al. | |
| 7,954,252 | B2 * | 6/2011 | Mather | E21B 47/08 33/304 |
| 9,097,106 | B2 | 8/2015 | Dussan V et al. | |
| 2014/0311234 | A1 | 10/2014 | Sherrill | |

FOREIGN PATENT DOCUMENTS

| | | | | |
|---|---|---|---|---|
| CN | 1743644 A | * | 3/2006 | G01N 21/534 |
| EP | 1316674 | | 6/2003 | |
| EP | 3346092 | | 7/2018 | |

OTHER PUBLICATIONS

"PCT Application No. PCT/US2023/065856, International Search Report and Written Opinion", Jan. 5, 2024, 9 pages.

* cited by examiner

*Primary Examiner* — Jill E Culler

(74) *Attorney, Agent, or Firm* — DeLizio, Peacock, Lewin & Guerra LLP

(57) ABSTRACT

In various wellbore test systems, a probe mechanism that is extended to contact the formation within a wellbore, and retracted to allow movement of the test system, both rotationally and longitudinally, within the wellbore. A combination including monitoring an actuation fluid pressure used to actuate the probe mechanism to extend and to retract, and the use of one or more timers, provide information used to determine the position of the probe mechanism during the extension and retraction movements.

20 Claims, 13 Drawing Sheets

WELLBORE PROBE MOVEMENT CONTROL

TECHNICAL FILED

This disclosure generally relates to testing of conditions within a wellbore extending into a subterranean formation, and more specifically to control of a wellbore probe.

BACKGROUND

During the drilling and completion of oil and gas wells, it is often necessary to engage in ancillary operations, such as monitoring the operability of equipment used during the drilling process or evaluating the production capabilities of formations intersected by the wellbore. For example, after a wellbore or wellbore interval has been drilled, zones of interest within the wellbore or wellbore interval may be tested to determine various formation properties such as permeability, fluid type, fluid quality, formation pressure, and formation pressure gradient. In various examples these tests are performed in order to determine whether commercial exploitation of the intersected formation(s) is/are viable.

Figure 1:
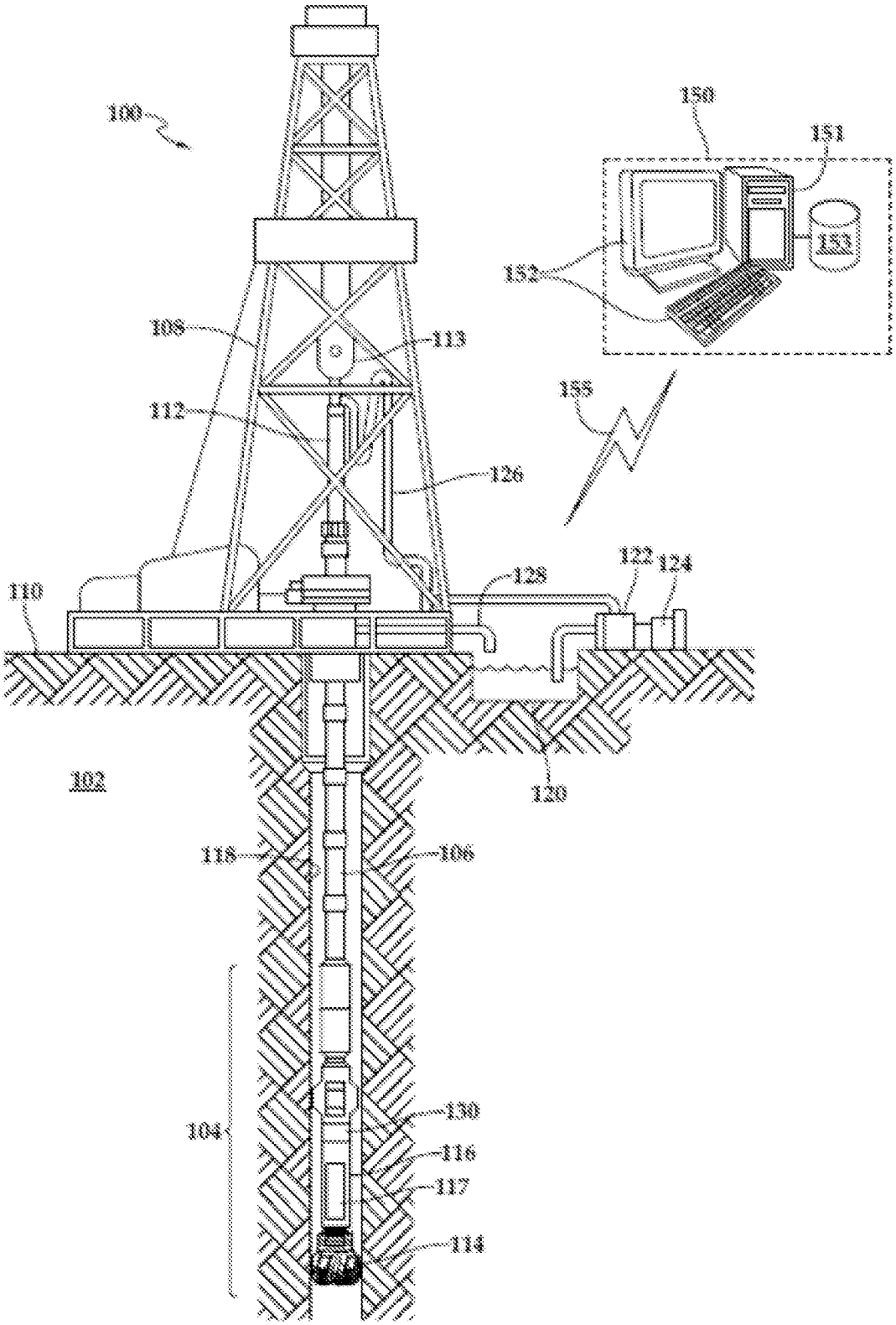
FIG. 1 illustrates a well system for drilling a wellbore in accordance with various embodiments.

The drawings are provided for the purpose of illustrating example embodiments. The scope of the claims and of the disclosure are not necessarily limited to the systems, apparatus, methods, or techniques, or any arrangements thereof, as illustrated in these figures. In the drawings and description that follow, like parts are typically marked throughout the specification and drawings with the same or coordinated reference numerals. The drawing figures are not necessarily to scale. Certain features of the invention may be shown exaggerated in scale or in somewhat schematic form, and some details of conventional elements may not be shown in the interest of clarity and conciseness.

DETAILED DESCRIPTION

In the following detailed description of the illustrative embodiments, reference is made to the accompanying drawings that form a part hereof. These embodiments are described in sufficient detail to enable those skilled in the art to practice the techniques and methods described herein, and it is understood that other embodiments may be utilized, and that logical structural, mechanical, electrical, and chemical changes may be made without departing from the scope of the disclosure. To avoid detail not necessary to enable those skilled in the art to practice the embodiments described herein, the description may omit certain information known to those skilled in the art. The following detailed description is, therefore, not to be taken in a limiting sense.

In various embodiments of wellbore test systems, a probe mechanism that can be extended to contact the formation within a wellbore, and retracted to allow movement, both rotationally and longitudinally, of the tool including the probe mechanism are utilized. With such systems, there is always a need to know the probe position, for example to determine proper probe sealing with the formation, and to determine if the probe mechanism is in a "safe" position, such as a fully retracted position, so that the tool can be moved within the wellbore without incurring damage to the probe mechanism. Currently some systems in use utilize a linear potentiometer as a sensor to locate and determine the position the probe. However, this technique adds machining and wiring complexity in the tool, especially for example in a 4¾ inches (12.065 centimeter) sized wellbore tool. To address this issue and eliminate the need for the linear potentiometer and associated devices and hardware, embodiments as described herein utilize motor rpm along with pump output and one or more timers to determine the exact probe position by reading pressure signals, and based on the one or more timers. The devices, methods and techniques as described herein remove the need for a linear measurement sensor and therefore the complexities and cost associated with these devices by modifying an algorithm and using existing motor-pump and pressure transducer relationships.

In embodiments of probe tools as described herein, measurements of motor rpm and pressure signals within the fluid system controlling the movements of the probe mechanism are provided by sensors. In each tool, oil volume needed to stroke the piston is constant. Embodiments include driving a positive displacement pump at a constant rpm to move a piston that in turn controls the extension and retraction of the probe mechanism configured to contact the formation within a wellbore where the probe tool is located. Based on the known the pump output, a calculation can be made as to the time required to move the piston from zero (i.e., a fully retracted position) to a final position. The piston movement creates a pressure signal, wherein embodiments as described below utilize this pressure signal monitored over a given time to determine the piston position. By using this pressure signal and timer, a determination of the piston position can be made, and a determination can be made as to whether the probe mechanism has or has not made contact with a formation material inside a wellbore where the probe tool is located. In addition, a detection of leaks in the system can be made. Further, a determination can be made that the probe tool is located in an oversized portion of the borehole within the wellbore where the probe tool is located.

By using this information, predictions regarding the probability of proper probe sealing against the formation can be made, along with a determination as to whether a portion of a borehole is oversized. These determinations save time, and thus costs, that would otherwise be needed for pressure sampling at a location that, because of poor or no contact between the probe mechanism and the formation, will generated inaccurate or no usable data. Because the methods and techniques described herein allow a determination as to whether the probe mechanism has sealed with the formation before starting sampling and measurement process, time and cost will be saved by only running the testing, measurement, and/or sampling processes when the probe mechanism has properly engaged the formation within the wellbore. In addition, maintenance and repair cost may be reduced by utilizing the devices as described herein due to the use of less components and less calibrations needed. This also eliminates a mode of failure by removing a sensor from the tool. This saves operation time and cost by allowing a determination of proper level of sealing between the probe mechanism and formation to be made beforehand, which may avoid spending time in performing the first drawdown to predict the sealing effectiveness.

Although the devices as described below are directed to probe mechanisms utilized for formation testing, these same or similar methods and techniques can be applied to rotary steerable system (RSS) borehole measurement and caliper measurement devices and apparatus.

FIG. 1 illustrates a well system 100 for drilling a wellbore in accordance with various embodiments. Well system 100 is configured to include a probe tool for measuring properties of downhole material, such as downhole fluids, to determine the chemical composition or other aspects of the downhole materials, including analysis of multiphase fluids, and for collecting samples of formation fluids from downhole within a wellbore. The resultant downhole material properties information may be utilized for various purposes, such as for modifying a drilling parameter or configuration, such as penetration rate or drilling direction, in a measurement-while-drilling (MWD) and a logging-while-drilling (LWD) operation. Well system 100 may be configured to drive a bottom hole assembly (BHA) 104 positioned or otherwise arranged at the bottom of a drill string 106 extended into the earth 102 from a derrick 108 arranged at the surface 110. Derrick 108 may include a kelly 112 and a traveling block 113 used to lower and raise kelly 112 and drill string 106.

BHA 104 may include a drill bit 114 operatively coupled to a tool string 116 that may be moved axially within a drilled wellbore 118 as attached to the drill string 106. During operation, drill bit 114 penetrates the earth 102 and thereby creates and extends wellbore 118. BHA 104 may provide directional control of drill bit 114 as it advances into the earth 102. Tool string 116 can be semi-permanently mounted with various measurement tools 117 such as, but not limited to, MWD and LWD tools, which may be configured to perform downhole measurements of downhole conditions. In some embodiments, the measurement tools 117 work in conjunction with a probe tool as described in this disclosure, and may be self-contained within tool string 116. In various embodiments, measurement tools 117 may be configured to perform one or more procedures including testing, measuring, and/or sampling of a portion of a formation that is engaged by a probe mechanism of a probe tools as described herein.

In well system 100, drilling fluid from a drilling fluid tank 120 may contain a quantity of drilling fluid that is pumped downhole using a pump 122 powered by an adjacent power source, such as a prime mover or motor 124. The drilling fluid may be pumped from the tank 120, through a standpipe 126, which feeds the drilling fluid into drill string 106, which conveys the drilling fluid to drill bit 114. The drilling fluid exits one or more nozzles arranged in drill bit 114, and in the process cools the drill bit. After exiting drill bit 114, the drilling fluid circulates back to the surface 110 via the annulus defined between wellbore 118 and drill string 106, and in the process, returns drill cuttings and debris to the surface. The returning cuttings and mud mixture are passed through a flow line 128 and are processed such that a cleaned drilling fluid is returned to tank 120 and is available to be recirculated downhole through standpipe 126.

Tool string 116 may further include a probe tool 130 that is the same as or similar to the probe tools as described herein. More particularly, probe tool 130 may have a moveable portion including a probe mechanism, as further described below, that is configured to be extended outward from the tool string 116 and to engage a portion of the formation material adjacent to the probe tool within the wellbore 118. While extended to engage the formation, probe tool includes or is coupled with one or more test apparatus, for example measurement tools 117, which allows for various tests, measurements, and/or sampling procedures to be performed on the formation engaged by the probe mechanism. Upon completion of the tests, measurements, and/or sampling procedures, the probe mechanism is configured to be retractable so that the tool string 116 can be moved, for example rotated and/or moved longitudinally within the wellbore 118, in order to continue with one or more drilling operations being performed on the wellbore.

In various embodiments the probe tool 130 included as part of tool string 116 includes a controller that includes one or more processors and computer memory configured to execute instructions for controlling the operations, including the extension and the retraction of the moveable portions of the probe tool. While not illustrated in FIG. 1, embodiments of the controller for the probe tool are illustrated and described below with respect to computer system 800 and FIG. 8.

Referring back to FIG. 1, in various embodiments probe tool 130 is configured to communicate with one or more other computer devices, such as user interface 150, which may be located above surface 110, and proximate the site of the wellbore 118, or remotely located from the site of the wellbore. User interface 150 may include a computing device 151, such as a personal computer, a lap-top computer, or some other type of user interface device, such as a smart phone. In various embodiments, user interface 150 includes one or more input/output devices 152, for example a display device such as a computer monitor, which is configured to provide visual display of data and other information related to well system 100 and/or to a fluid treatment process being performed on or modeled for wellbore 118. In various embodiments, the display device is configured to display information regarding data received at user interface 150 from the downhole probe tool 130 and/or measurement tools 117 related to the status and/or other parameters associated with the operation of the probe tool. The computer system of user interface 150 may include one or more additional input devices, such as a computer keyboard, computer mouse, and/or a touch screen that allows a user, such as a technician or engineer, to provide inputs to user interface 150, which may include requests for information regarding the status of well system 100 and/or inputs that may be used to direct the operations of the probe tool 130.

In various embodiments, communications between user interface 150 and probe tool 130 may include a signal from the user interface to the probe tool indicating that the tool string is positioned at a location within the wellbore 118 where testing of the formation is desired, and that the rotational operation of the drill sting 116 has been halted. Additional communications between user interface 150 and probe tool 130 may include a signal from the probe tool to the user interface indicating that the testing, measurement, and/or sampling procedures being performed by the probe tool have been completed, and that the probe mechanism has been fully retracted so that the drilling operations and/or repositioning of the tool string 116 within the wellbore 118 may proceed. Further communications between the probe tool and the user interface may include transmission of data, in some embodiments in real time, resulting from the testing and/or measurements performed by the probe tool while extended to engage the formation within the wellbore. Connections between user interface 150 and other devices included in in well system 100 may be provided by wired and/or wireless communication connection(s), as illustratively represented by lightning bolt 155.

User interface 150 is communicatively coupled to a non-volatile computer readable memory device 153. Memory device 153 is not limited to any particular type of memory device. Memory device 153 may store instructions, such as one or more applications, that when operated on by the processor(s) of the computing device 151, are configured to control the operations of one or more of the devices included in well system 100. Any combination of one or more machine readable medium(s) may be utilized. The machine readable medium may be a machine readable signal medium or a machine readable storage medium. A machine readable storage medium may be, for example, but not limited to, a system, apparatus, or device, which employs any one of or combination of electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine readable storage medium may be any tangible medium that can contain, or store a program for use by or in connection with an instruction execution system, apparatus, or device. A machine-readable storage medium is not a machine-readable signal medium.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine readable storage medium and that can communicate, propagate, or transport a program for use by or in connection with an instruction execution system, apparatus, or device.

Program code embodied on a machine readable medium may be transmitted using any appropriate medium, including but not limited to wireless, wireline, optical fiber cable, RF, etc., or any suitable combination of the foregoing. Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine. The program code/instructions may also be stored in a machine readable medium that can direct a machine to function in a particular manner, such that the instructions stored in the machine readable medium produce an article of manufacture including instructions which implement the function/act specified in the flowchart and/or block diagram block or blocks.

Figure 2:
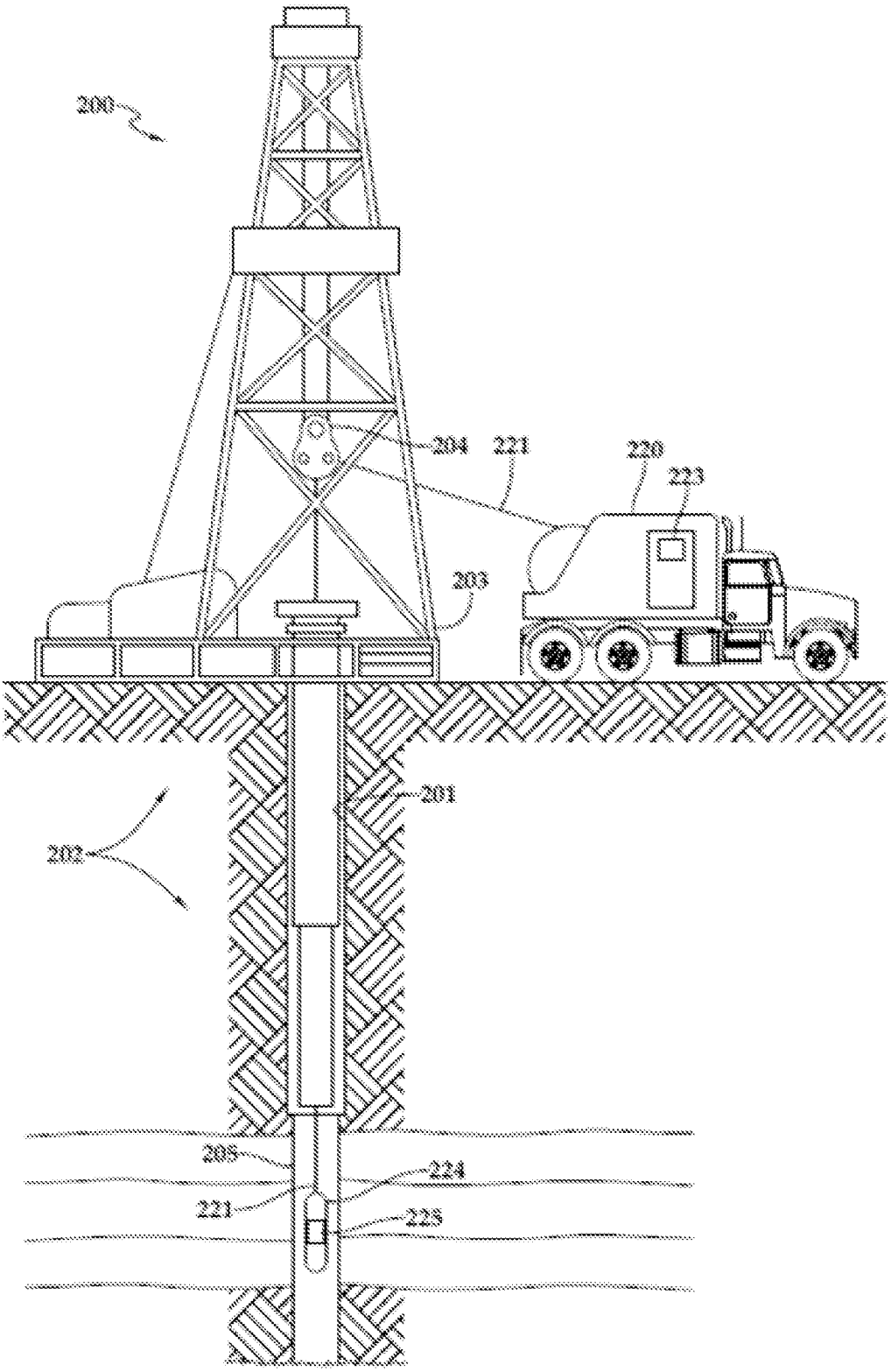
FIG. 2 illustrates a wireline system for testing a wellbore in accordance with various embodiments.

FIG. 2 illustrates a wireline system 200 for testing a wellbore in accordance with various embodiments. In some embodiments, wireline system 200 may be configured to use a probe tool 225, such as the probe tool illustrated and described below with respect to FIGS. 4A-4B and 5A-5B. Referring back to FIG. 2, after drilling of wellbore 201 is complete or halted, it may be desirable to determine details regarding composition of formation fluids and other downhole fluids, and associated properties of these downhole fluids, through wireline sampling. Wireline system 200 may include a downhole tool 224 that forms part of a wireline logging operation, which may include a probe tool 225, as described herein, as part of a downhole measurement tool. Wireline system 200 may include a derrick 203 that supports a traveling block 204. Downhole tool 224, which may be a probe or sonde, may be lowered by a wireline cable 221 into wellbore 201 extending into formation 202.

Downhole tool 224 may be lowered to potential production zone 205 or other regions of interest within wellbore 201, and used in conjunction with other components, such as packers and pumps, to perform well testing and sampling. Probe tool 225 may be configured to perform any of the functions, and to provide any of the features as described throughout this disclosure ascribed for a probe tool, and any equivalents thereof. More particularly, probe tool 225 may include a moveable portion including a probe mechanism, as further described below, that is configured to engage the formation 202, for example in the production zone and/or along any uncased portion the wellbore 201, and to perform testing, measurements, and or sampling of the formation in the portion of the wellbore engaged by the probe tool. In various embodiments, probe tool 225 may be configured to measure one or more physical parameter of downhole fluids, such as but not limited formation fluid pressure(s). In various embodiments, probe tool 225 is configured to transmit any measurement data generated by the probe tool to a surface logging facility 220 for storage, processing, and/or analysis and display. Surface logging facility 220 may be provided with electronic equipment 223, including processors for various types of data and signal processing equipment configured to perform at least some steps of the methods consistent with the present disclosure. In various embodiments, electronic equipment may comprise any or all of the components described above with respect to user interface 150. Probe tool 225 may be configured to perform any of the functions, and to provide any of the features as described throughout this disclosure ascribed for an probe tool, and/or any equivalents thereof.

Although FIGS. 1 and 2 depict specific borehole configurations, it should be understood by those skilled in the art that the present disclosure is equally well suited for use in wellbores having other orientations including vertical wellbores, horizontal wellbores, slanted wellbores, multilateral wellbores and the like. Also, even though FIGS. 1 and 2 depict an onshore operation, it should be understood by those skilled in the art that the present disclosure is equally well suited for use in offshore operations. Moreover, it should be understood by those skilled in the art that the present disclosure is not limited to the environments depicted in FIGS. 1 and 2, and can also be used, for example, in other well operations such as non-conductive production tubing operations, jointed tubing operations, coiled tubing operations, combinations thereof, and the like.

Figure 3:
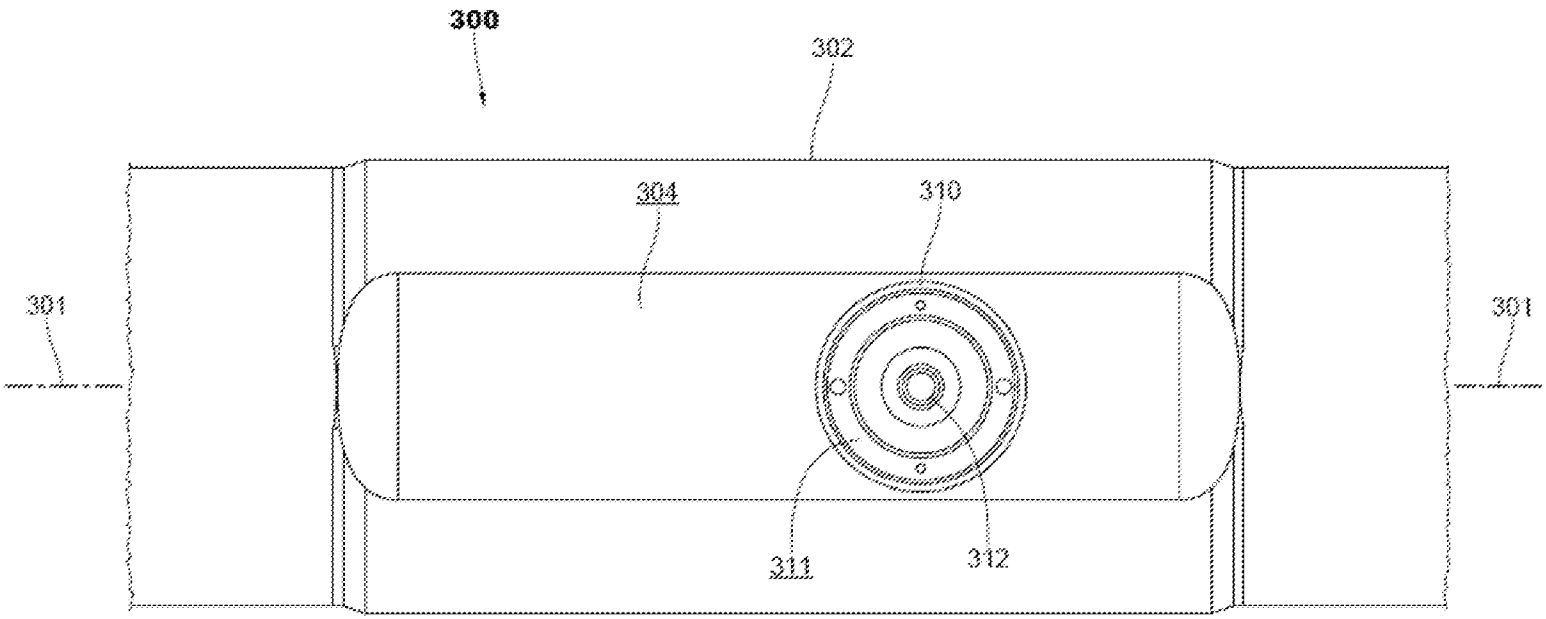
FIG. 3 illustrates a side view of a portion of a downhole tool that includes a probe tool in accordance with various embodiments.

FIG. 3 illustrates a side view of a portion of a downhole tool 300 that includes a probe tool in accordance with various embodiments. In various embodiments, downhole tool 300 is part of a bottom hole assembly configured to perform drilling operations, such as bottom hole assembly 104 as illustrated and described above with respect to FIG. 1. In various embodiments, the downhole tool 300 is part of a wireline system, such as wireline system 200 as illustrated and described above with respect to FIG. 2.

As shown in FIG. 3, downhole tool 300 includes a tool body 302 that extends along a longitudinal axis 301, and in various embodiments has a circular shape or partially circular shape in cross-section. A portion of the tool body 302 includes a recessed surface 304 that intruded inward relative to the remainder of the outer surface of the tool body 302. A probe tool is positioned within the tool body 302 such that a probe mechanism 310 of the probe tool extends to and is located at an opening in the recessed surface 304. The probe mechanism includes a deformable member including a contact surface 311 that is configured to make a sealed contact with a portion of the wall of a wellbore to form a hydraulic seal between the contact surface 311 and the wall of the wellbore. In order to form the seal, the probe tool is configured to actuate the probe mechanism 310 so that the probe mechanism is extended radially outward and away from the longitudinal axis 301 such that the contact surface 311 is brought into contact with the wall of a wellbore where the downhole tool 300 is located. Once a sealed contact is formed between the probe mechanism 310 and the wall of the wellbore, one or more test, measurement, and/or sampling procedures may be performed by one or more types of testing apparatus coupled to the probe mechanism 310 through a passageway 312 that extends through the probe mechanism and into the tool body 302.

The types and number of tests, measurements, and/or sampling procedures that may be performed while the probe mechanism is in contact with the wall of the wellbore is not limited to any particular type of tests, measurements, and/or sampling procedures, or to any particular number of tests and/or measurements and/or sampling procedures. Testing may include measurements of formation pressures, fluid flow testing including fluid injection testing, drill stem testing, and sample collection operations. When testing is completed, the probe tool is configured to retract the probe mechanism 310 such that the probe mechanism again resides within the recessed surface 304 of the tool body 302. Having the probe mechanism positioned within the recessed surface 304 allows for movement of the downhole tool 300 longitudinally and/or rotationally within the wellbore while protecting the probe mechanism 310 and the contact surface 311 from abrasion and physical damage that could otherwise result for contact with the surfaces of the wellbore and/or other objects, such as debris, centralizers, packers, and other structures that may be present in the wellbore where the downhole tool 300 is being deployed.

Figure 4A:
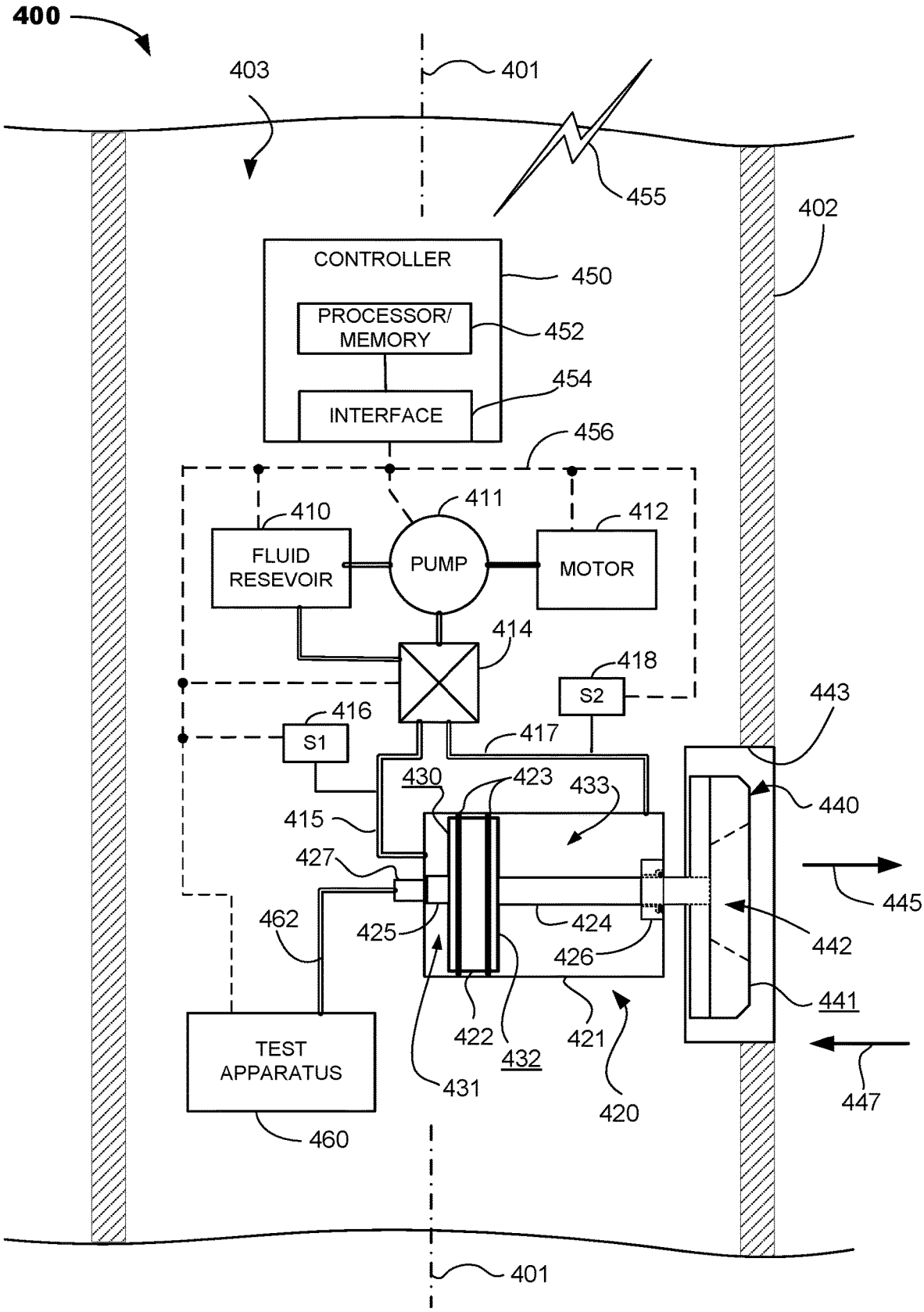
FIG. 4A illustrates a conceptual block diagram of a probe tool for performing testing, measurements, and/or sampling within a wellbore in accordance with various embodiments.

FIG. 4A illustrates a conceptual block diagram of a probe tool 400 for performing testing, measurements, and/or sampling within a wellbore in accordance with various embodiments. Probe tool 400 may be an embodiment of probe tool 130 included as part of a bottom hole assembly of a drill string, such a bottom hole assembly 104 as illustrated and described with respect to FIG. 1. Probe tool 400 may be an embodiment of probe tool 225 included in a wireline device such as wireline system 200 as illustrated and described with respect to FIG. 2. Devices as illustratively represented by graphical elements and/or symbols used in FIG. 4A are not necessarily illustrative of the actual shape, configuration, and/or size of the device(s) these graphical elements represent, and are intended to provide information about the relative arrangements and the function(s) provided by these represented devices.

As shown in FIG. 4A, probe tool 400 is located within a tool body 402, wherein tool body 402 extends along longitudinal axis 401 and is configured to encircle and at least partially enclose the components that comprise the probe tool within an inner space 403 of the tool body. Embodiments of probe tool 400 include some combination of a fluid reservoir 410, a pump 411, a motor 412, a valve assembly 414, and a piston assembly 420 mechanically coupled to a probe mechanism 440. Probe tool 400 is configured to actuate the piston assembly 420 in order to extend probe mechanism 440 outward and beyond the tool body 402 in a radial direction as indicated by arrow 445 so that the probe mechanism makes contact with a wall of a wellbore where the probe tool is located. When a desired level of contact has been verified using the techniques as disclosed herein between the probe mechanism 440 and the wall of the wellbore, one or more testing procedures, including but not limited to pressure measurements, may be performed by test apparatus 460 while the probe mechanism remains in sealing contact with the wall of the wellbore. Upon completion of the testing procedure(s) being performed while the probe mechanism 440 is in contact with the wall of the wellbore, probe tool 400 is configured to actuate the piston assembly 420 to cause the probe mechanism 440 to be retracted back toward the tool body 402 in the direction indicted by arrow 447, and to return to the fully retracted position within recessed surface 443 of the tool body 402.

As shown in FIG. 4A, piston assembly 420 comprises a piston 422 positioned within a piston sleeve 421. Piston 422 includes one or more seals 423 that provide a fluid seal between the piston 422 and the inner surface of the piston sleeve 421. The piston 422 separates a first cavity 431 within the piston assembly from a second cavity 433 within the piston assembly and on an opposite side of the piston relative to the first cavity. Piston 422 is held in place within the piston sleeve 421 by a movable shaft 424 and a fixed shaft 427, wherein piston 422 is configured to move back and forth within piston sleeve 421 based on a difference in the fluid pressures present in the first cavity 431 and the second cavity 433. Because the piston 422, shaft 424, and probe mechanism 440 of the probe tool are moveable in a radial direction relative to the longitudinal axis 401, these components may be referred to herein as the "movable portion" or movable portions" of the probe tool.

For example, when in the fully retracted position as illustrated in FIG. 4A, when a fluid pressure in the first cavity 431 is greater than a fluid pressure in the second cavity 433, fluid pressure exerted in a first surface 430 of the piston 422 causes the piston to be moved within the piston sleeve in a direction indicted by arrow 445. The probe mechanism 440 is mechanically coupled to the piston 422 through shaft 424. Therefore, as the piston 422 moves in the direction of arrow 445, the probe mechanism also moves in the direction of arrow 445, and thereby is extended in a radial direction outward from longitudinal axis 401 and out and away from the tool body 402. In various embodiments, an outbound mechanical stop 426 limits the travel of piston 422 in the direction of arrow 445 by blocking further movement of the piston when the second surface 432 of the piston comes into contact with the outbound mechanical stop.

In order to retract the probe mechanism 440 to the fully retracted position as illustrated in FIG. 4A, fluid pressures within the piston sleeve 421 are configured so that a fluid pressure in the second cavity 433 is made greater than a fluid pressure in the first cavity 431. As a result, a fluid pressure exerted on a second surface 432 of the piston 422 that is in fluid communication with the second cavity 433 causes the piston to move within the piston sleeve in a direction indicted by arrow 447. Because the probe mechanism 440 is mechanically coupled to the piston 422 through shaft 424, as the piston 422 moves in the direction of arrow 447 the probe mechanism also moves in the direction of arrow 447, and thereby is retracted in a radial direction inward and toward the longitudinal axis 401. In various embodiments, an inbound mechanical stop 425 limits the travel of piston 422 in the direction of arrow 447 by blocking further movement of the piston when the first surface 430 of the piston comes into contact with the inbound mechanical stop, or when the inbound mechanical stop 425 is included as part of the movable portions of the probe tool and comes in contact with the end of the piston sleeve 421, both of which correspond to the probe mechanism 440 being fully retracted and positioned within recessed surface 443.

Embodiments of the probe tool include additional devices configured to operate and control the piston 422 and the probe mechanism 440 to extend and retract the probe mechanism as described above. For example, as shown in FIG. 4A, motor 412 is mechanically coupled to pump 411 and is configured to operate pump 411 so that pump 411 provides fluid pressure and fluid flow to valve assembly 414 when operated by the motor. Pump 411 is coupled by a fluid conduit to fluid reservoir 410 that allows the pump to draw fluid from the fluid reservoir, and provide a flow of pressurized fluid to the valve assembly 414. Valve assembly 414 is coupled to and is in fluid communication with the first cavity 431 of the piston sleeve 421 through fluid conduit 415, and is coupled to and is in fluid communication with the second cavity 433 of the piston sleeve 421 through fluid conduit 417. Valve assembly 414 may be controllably operated so that fluid flow and fluid pressure provided to the valve assembly by pump 411 is communicated to the first cavity 431 while allowing fluid pressure in the second cavity 433 to be returned to the fluid reservoir 410 through fluid conduit 417 and the valve assembly. In this configuration, the fluid pressure generated on the first surface 430 of the piston 422 can be greater than a fluid pressure present at the second surface 432 of the piston, resulting in the piston moving in the direction of arrow 445 and extending the probe mechanism 440 away from the tool body 402.

In addition, valve assembly 414 may be controllably operated so that fluid flow and fluid pressure provided to the valve assembly by pump 411 is communicated to the second cavity 433 while allowing fluid present in the first cavity 431 to be returned to the fluid reservoir 410 through fluid conduit 415 and the valve assembly. In this configuration, the fluid pressure generated on the second surface 432 of the piston 422 can be greater than a fluid pressure present at the first surface 430 of the piston, resulting in the piston moving in the direction of arrow 447, and retracting the probe mechanism 440 back toward the tool body 402. Thus, by controlling the direction of fluid pressures provided to the cavities of the piston assembly, and thus the pressure differential across piston 422, movement of the piston to extend or to retract the probe mechanism 440 can be controlled.

As shown in FIG. 4A, one or more sensors 416 may be configured to monitor one or more physical parameters, such as fluid flow rate and/or fluid pressure levels, present in fluid conduit 415, and thus present in the first cavity 431 of the piston sleeve 421. One or more sensors 418 may be configured to monitor one or more physical parameters, such as fluid flow rate and/or fluid pressure levels, present in fluid conduit 417, and thus present in the second cavity 433 of the piston sleeve 421. Output signals provided by these sensors may be communicated through communications link 456, and received by interface 454 of controller 450, and thus made available to the processor/memory 452 of the controller.

In various embodiments, the pump 411 is a positive displacement pump configured to provide a known quantity of fluid flow, for example for each revolution or partial revolution of the pump. By controlling the number of full and/or partial revolutions of pump 411 by controlling the operation of motor 412, a known quantity of fluid flow can be provided by pump 411 over a given time interval. By providing a known quantity of fluid flow to the piston assembly 420, the amount of corresponding movement of the piston 422, and thus the movement of probe mechanism 440, may be determined. By further monitoring a level of pressure within a supply line, such as fluid conduit 415 during an extension of the probe mechanism 440, or fluid conduit 417 during a retraction of the probe mechanism, a determination may be made as to whether a desired result of the operation of the probe mechanism has been achieved. A desired result of the operation of the probe mechanism may include actuating the probe mechanism to achieve a sealing contact with the wall of the wellbore where the probe mechanism is positioned and/or to achieve full retraction of the probe mechanism back to or within the tool body 402 of the probe tool 400.

In order to operate the probe tool 400 to extend and retract as described above, in various embodiments controller 450 provides control signals to more or more devices of the probe tool. In various embodiments, controller 450 includes a processor and memory 452, wherein the memory has stored instructions and data that allow the process to operate on the instructions and data in order to control the operations of probe tool 400. Controller 450 includes an interface that is communicatively coupled to various devices included in the probe tool over communication link 456. In various embodiments, controller 450 is communicatively coupled to one or more of devices including the fluid reservoir 410, the pump 411, the motor 412, the valve assembly 414, sensors (S1) 416, sensors (S2) 418, and test apparatus 460. Controller 450 may be configured to control operating parameters of motor 412 to turn the motor on and off, and to set the rate of rotation of the motor. Controller 450 may also receive signals such as encoder signals, from motor 412 indicative of the amount and/or rate of rotation of the motor. By controlling the operating parameters for motor 412, controller 450 is able to control the operation of pump 411, including knowing the amount of fluid provided to the piston assembly 420 over a given period of time. By knowing the amount of fluid flow and by monitoring the pressure levels and/or the pressure differential present on both sides of the piston 422, controller 450 can determine the amount of travel of the piston and/or the position of the piston, and thus the position of the probe mechanism 440.

For example, by pressuring the piston assembly 420 so that the piston is configured to extend away from the tool body 402 while setting an extension timer and monitoring the pressure level for example in the first cavity 431, the controller can determine whether the piston extended and made contact with a wall of the wellbore where the probe tool is located, or whether the piston extended to the fully extended position without making contact with the wall of the wellbore. In various embodiments, the expiration time set of the extension timer is the time determined for the probe mechanism to reach a fully extended position based on the controlled operation of the motor 412 and pump 411. If the controller receives a signal from a pressure sensor indicating that the pressure present in first cavity 431 of the piston assembly 420 exceeds a threshold pressure level before expiration of the extension time, the controller can determine the position of the probe mechanism, and also determines that the probe mechanism has made contact with the wall of the wellbore where the probe tool is located, and therefore did not reach the fully extended position. The increase in the pressure level in excess of the threshold pressure level is due to the stopping of the further extension of the piston and the probe mechanism due to the contact of the probe mechanism with the wall of the wellbore. In the alternative, if the controller only receives a signal from a pressure sensor indicating that the pressure present in first cavity 431 of the piston assembly 420 did not exceed a threshold pressure level before expiration of the extension time, the controller can determine the probe mechanism has reached a position of being fully extended, and reached that position without contacting the wall of the wellbore.

If controller 450 determines that the probe mechanism 440 did engage the wall of the wellbore during and extension of the piston 422 and the probe mechanism 440, controller 450 can configure the motor, 412, pump 411, and/or the valve assembly 414 to apply an increased pressure to the piston, and thus to the probe mechanism, to assure a sealing contact between the probe mechanism and the formation of the wellbore. During this time, the controller may signal the test apparatus 460 that the probe mechanism 440 is in contact with the formation material of the wellbore, and that the test apparatus can proceed with testing, measurements, and/or sampling operations on the formation. Test apparatus 460 is coupled to the formation through conduit 462 and through passageway 442 extending through probe mechanism 440 and shaft 424. Test apparatus 460 may be configured to perform one or more tests, such as fluid injection tests, fluid flow testing, pressure measurement, and/or other tests related to gathering information about the portion of the formation engaged with the probe mechanism 440. Upon completion of any procedures being performed by test apparatus 460, test apparatus may be configured to signal the controller 450 that the procedures have been completed using communication link 456.

Upon receiving the indication from test apparatus 460 that the test procedure(s) are competed, controller 450 may initiate a retraction sequence to retract the piston 422 and the probe mechanism 440 to the fully retracted position. With respect to controlling a retraction of the probe mechanism 440, controller 450 may control the operation of the motor 412, pump 411, and valve assembly 414 to pressurize the piston assembly 420 so that the piston is configured to retract back toward the tool body 402 while setting a retraction timer and monitoring the pressure level for example in the second cavity 433 of the piston assembly, to determine whether the piston was successfully retracted to the fully retracted position. In various embodiments, the retraction time set for the expiration of the retraction timer is the time determined for the probe mechanism to fully retract from a position determined for the probed mechanism. The position determined for the probe mechanism may be an intermediate position in instances where the probe mechanism made contact with wall of the wellbore where the probe tool is located as part of an probe extension, or at the fully extended potion in instances where the probe was extended and do not make contact with the wall of the wellbore.

In various embodiments of the retraction, if the controller receives a signal from a pressure sensor indicating that the pressure present in second cavity 433 remained below a threshold pressure level until the expiration of the retraction timer, and then receive a signal from the pressure sensor that the pressure present in the second cavity 433 exceeds the threshold pressure level, controller 450 may make a determination that the probe mechanism reached the fully retracted position. In the alternate, if the controller 450 received a signal from a pressure sensor indicating that the pressure present in second cavity 433 exceeded the threshold pressure level prior to the expiration of the retraction timer, controller 450 may make a determination that the probe assembly is jammed or is stuck on debris or some other structural object within the wellbore, and that the probe mechanism did not return to the fully retracted position.

In various embodiments, controller 450 is communicatively linked, as illustratively represented by lightning bolt as communication link 455, to another computer device, such as user interface 150 (FIG. 1), which is located outside of probe tool 400. In various embodiments, controller 450 may receive a signal over communication link 455 indicating that the downhole tool that includes probe tool 400 is in a position within a wellbore where actuation of the probe tool is requested. Based on this input, controller 450 may initiate an extension sequence of the probe tool, and if successful, request that test apparatus 460 proceed with one or more test procedures through the probe mechanism 440. In various embodiments, test results, data, and other information gathered and/or determined by test apparatus 460 may be communicated, in some instances in real-time, to devices outside of probe tool 400 using communication link 455. In various embodiments, upon making a determination that the probe tool 400 has been successfully retracted to the fully retraced position following an extension of the probe mechanism, controller 450 may be configured to provide an output signal to device(s) outside of the probe tool 400 using communication link 455 indicating that the probe tool is in a safe position to allow for movement of the downhole tool that includes the probe tool.

Figure 4B:
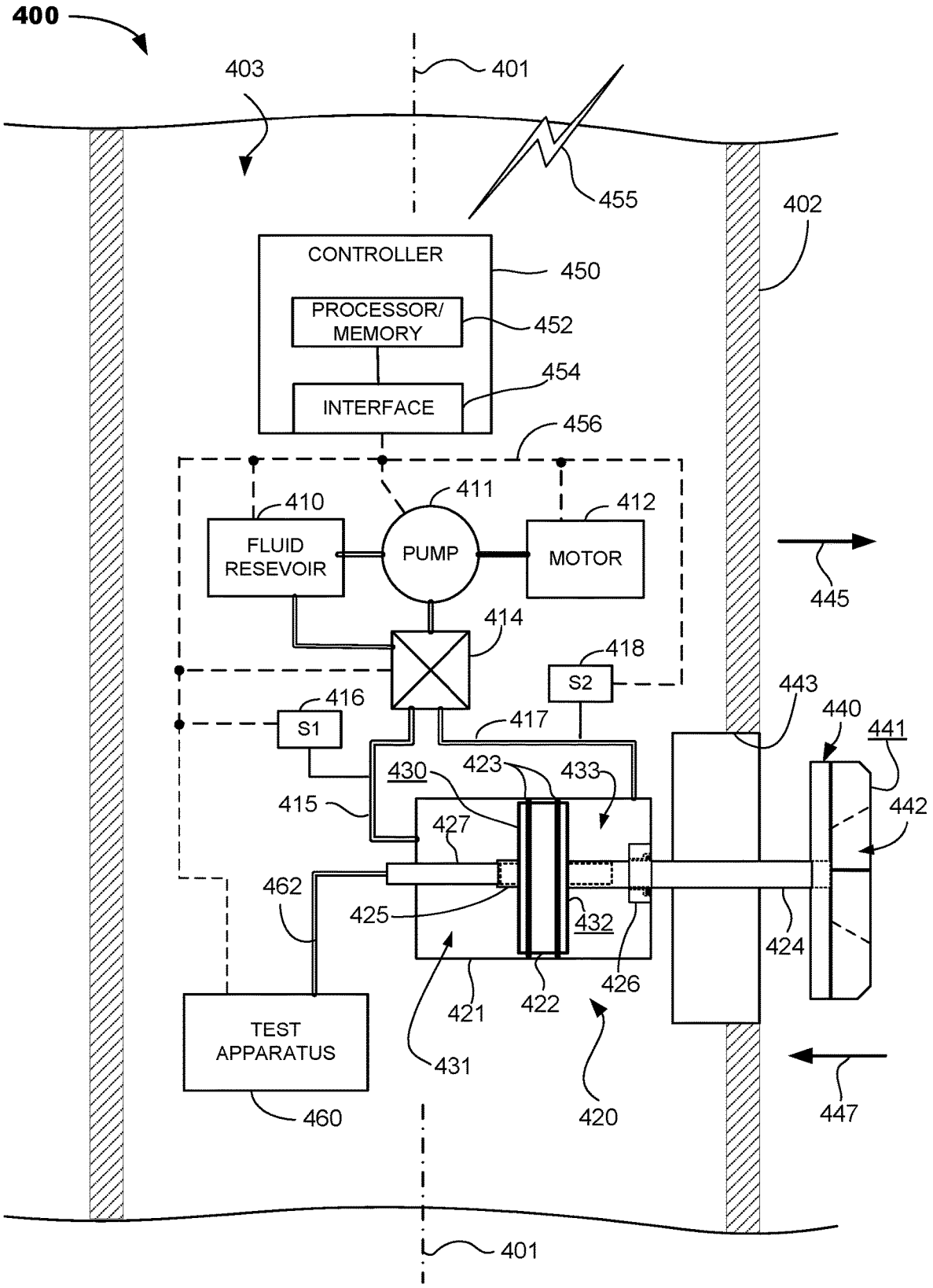
FIG. 4B illustrates a condition wherein the probe tool of FIG. 4A is positioned at an intermediate location o the fully retracted position and the fully extended position in accordance with various embodiments.

FIG. 4B illustrates a condition wherein probe tool 400 of FIG. 4A is positioned at an intermediate location between the fully retracted position and the fully extended position in accordance with various embodiments. As shown in FIG. 4B, probe mechanism 440 is positioned out and away from recessed surface 443 and tool body 402 of probe tool 400. This positioning of piston 422 and probe mechanism 440 may occur in various embodiments when the probe tool is actuated to extend the probe mechanism, and the probe mechanism has contacted a wall of a wellbore where the probe tool is located, thus preventing the further movement outward of the piston and the probe mechanism relative to the tool body 402. When in the position as shown in FIG. 4B, additional fluid pressure may be applied to the first cavity 431 to increase the force being applied to the formation of the wellbore contacted by the contacting surface 441 of the probe mechanism 440 in order to provide a sealing contact between the probe mechanism and the formation of the wellbore.

Figure 5A:
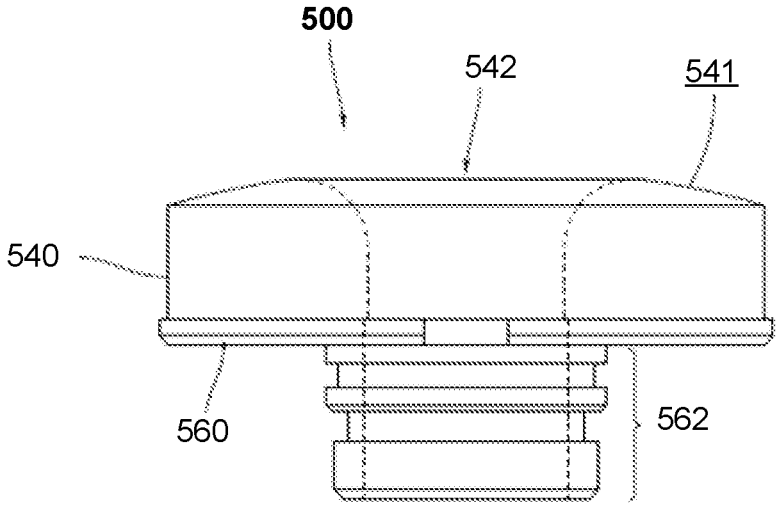
FIG. 5A illustrates a side view of an end cap for a probe mechanism for contacting a wall of a wellbore in accordance with various embodiments.

FIG. 5A illustrates a side view of an end cap 500 for a probe mechanism for contacting a wall of a wellbore in accordance with various embodiments. End cap 500 includes a collar 562, a plate 560 coupled to the collar, and a formable member 540 having a bottom surface in contact with an upper surface of plate 560. In various embodiments, formable member 540 comprises a contact surface 541 on the opposite side of the formable member 540 relative to the plate 560. In various embodiments, formable member 540 is formed from a resilient and compressible material, for example rubber, such that when contact surface 541 is brought into contact with a wall of a wellbore, and additional pressure is applied to the formable member by the probe mechanism through plate 560, formable member compresses and forms a hydraulic seal with a shape and/or the irregular surfaces of the wall of the wellbore where the probe mechanism is deployed.

In various embodiments, collar 562 is configured to couple to a shaft, such as coupling shaft 424 as illustrated and described with respect to FIGS. 4A-4B, to mechanically link the end cap 500 to the piston or other movable portions of the probe tool, and thus is extended and retraced with the movements of the piston or other moveable potions of the probe tool where the end cap is installed. In addition, embodiments of end cap 500 include a passageway 542 that extends from the contact surface 541 through the formable member 540, the plate 560, and the collar 562. Passageway 542 is configured to provide a passageway for fluid communication between a formation where the probe tool including the end cap 500 is deployed and one or more test apparatus located within the probe tool.

Figure 5B:
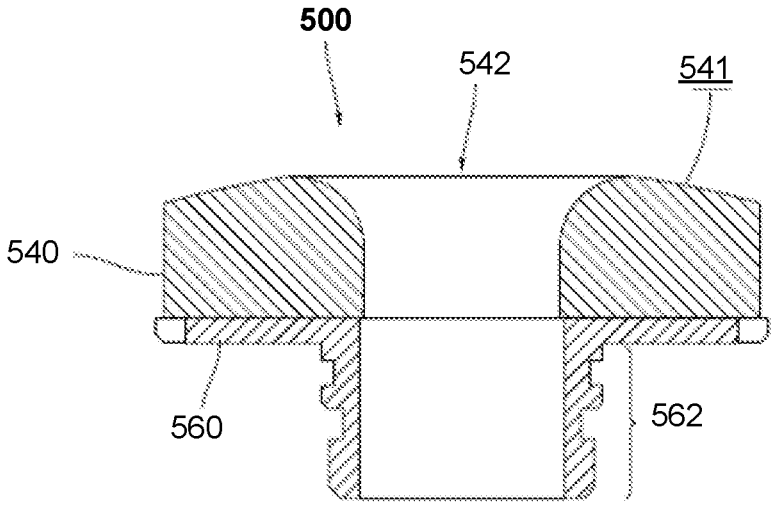
FIG. 5B illustrates a cutaway view of the end cap of FIG. 5A.

FIG. 5B illustrates a cutaway view of an end cap 500 of FIG. 5A. As shown in FIG. 5B, passageway 542 extends from contact surface 541 through the formable member 540, the plate 560, and the collar 562.

Figure 6A:
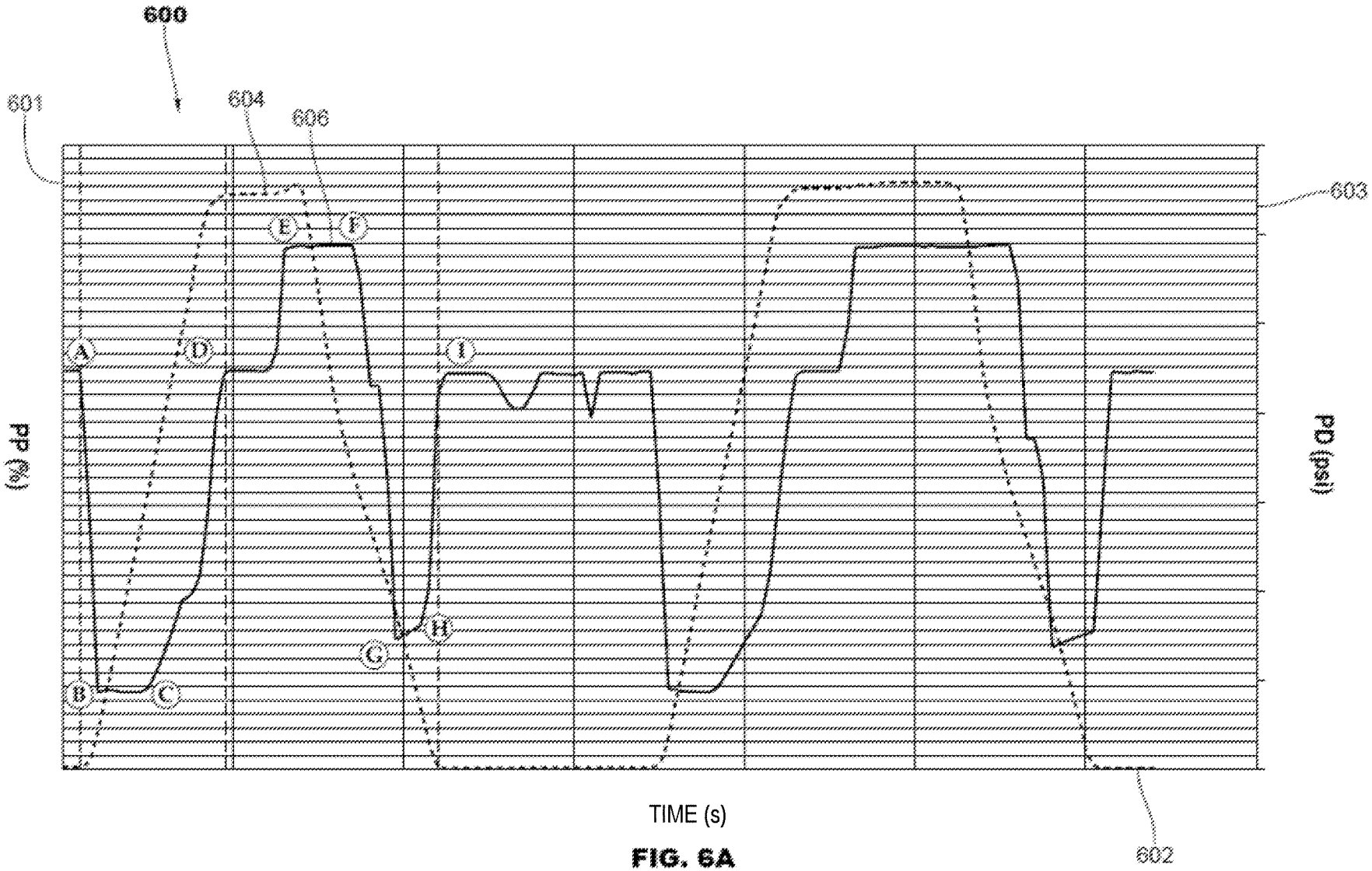
FIG. 6A illustrates a graph showing a comparison of measured probe tool position compared to monitored fluid pressures within the probe tool over at least one full extension and retraction cycle in accordance with various embodiments.

FIG. 6A illustrates a graph 600 showing a comparison of measured probe tool position compared to monitored fluid pressures within the probe tool over at least one full extension and retraction cycle in accordance with various embodiments. Graph 600 includes a vertical axis 601 positioned along the left-hand side of the graph that is indicative of a-percentage probe position (where 0% is fully retracted and 100% is fully extended). Graph 600 includes vertical axis 603 positioned along the right-hand side of the graph that is indicative of overall pressure within the probe tool in pounds per square inch. A horizontal axis 602 along the bottom of graph 600 is indicative of time in seconds. A dashed graphical line 604 extending from left to right in graph 600 is indicative of a measured position of the probe tool over one or more cycles of actuation to extend and retract the moveable portions of a probe tool. The solid graphical line 606 extending from left to right shows the variations in the pressure provided to the movable portions of the probe tool over time. A series of circled letters A through I are used to indicate inflection points and/or events that occurred as the pressure levels provided to and/or present in the probe tool varied over the time period represented within graph 600.

At time A in graph 600, pressure at the probe tool was approximately 2250 pounds per square inch (PSI) (15.52 megapascals (MPa)), and configured to retain the movable portions of the probe tool in the fully retracted position. Over the time period between time A and time B, pressure within the probe tool was dropped to a pressure level in a range of 500 and 600 PSI (between 3.45 and 4.14 MPa), which was maintained over the period of time between time B and time C. This lower pressure level is applied in order to initiate an actuation of the probe tool to begin to extend outward from the tool body of the probe tool. Over the time period between time C and time D, the fluid pressure within the probe tool was increased from between 500 to 600 PSI (3.45 to 4.14 MPa) to a pressure level of about 2250 PSI (15.52 MPa). As shown by dashed graphical line 604, the position of the probe tool extended outward from the tool body both over the time period between time B and time C under the lower pressure condition, and continued to extend over the time period between time C and time D.

At time period D the increase in pressure levels plateaued for a brief period of time, as indicated by solid graphical line 606 just to the right of time D, which corresponds to a stop in the further extension of the probe tool, as indicated by the plateau of the dashed graphical line 604 at around the 20 second mark in graph 600. This event marks the probe tool making contact with a formation proximate the location of the probe tool within a wellbore, wherein the contact with the formation prevents further extension of the probe tool from the tool body. The further increase in pressure within the probe tool applied between time D and E would be used to secure the seal between the sealing surface of the probe mechanism and the formation without further outward movement of the probe mechanism from the tool body.

At time F, the differential pressure within the probe tool is reduced from a pressure of approximately 2250 PSI (15.52 MPa) to a level just under 1000 PSI (6.89 MPa) over the time period between time F and time G. A corresponding movement of the moveable portions of the probe tool from the position where the probe mechanism is in contact with the formation to a fully retracted position, just after the 40 second mark in graph 600, is indicated by the decline in the position of the probe tool to the fully retracted position as indicated by the dashed graphical line 604 over the time period extending from about the 28 second mark to approximately the 45 second mark in graph 600. At time H, pressure is increased again to a pressure level of about 2250 (15.52 MPa) by time I, but the pressure is applied to the probe tool such that the fluid pressure maintains the moveable portions of the probe tool in the fully retracted position, as indicated by solid graphical line 606 maintaining a path along the horizontal axis of the graph. Time I represents a repeated condition for the probe tool consistent with that of time A, wherein the probe tool is fully retracted and is held in the fully retraced position by the fluid pressure being applied to the probe tool following time I. Following time I and while the probe tool remains in the fully retracted position, the probe tool may be relocated to another position within the wellbore, and a similar cycle of extension and retraction is performed as was indicated and describe above with respect to the operation of the probe tool over the time period extending between time A and time I.

As shown by the general correlation between the monitored fluid pressures as represented by solid graphical line 606 and the position of the movable portions of the probe tool as indicated by dashed graphical line 604, the monitored fluid pressure can be used to accurately determine the position and condition of the probe tool with respect to contacting formation material within a wellbore where the probe tool is located and operated.

Figure 6B:
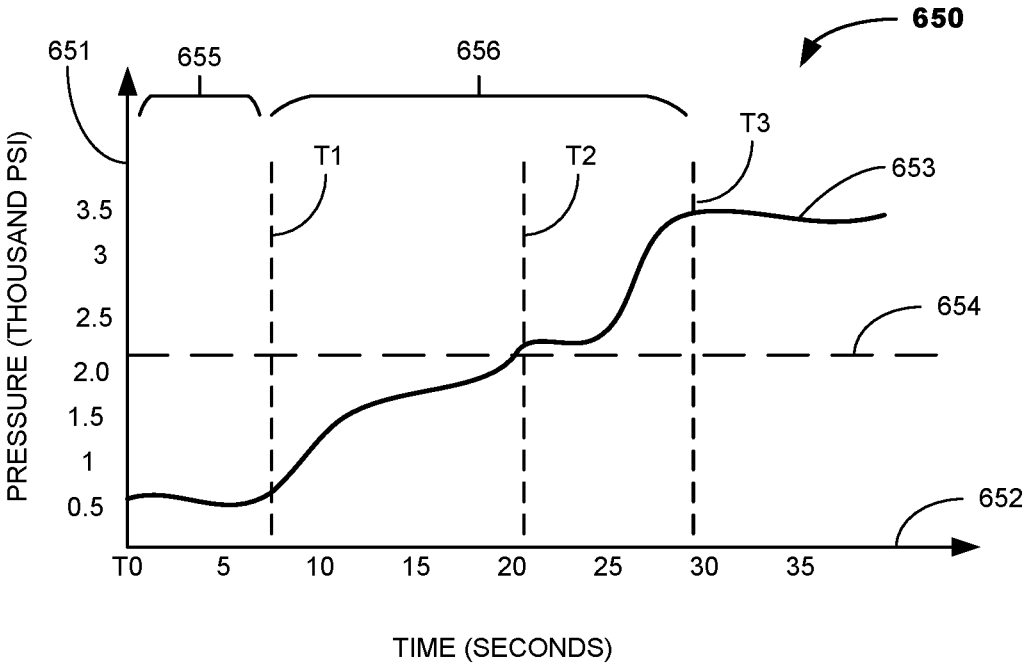
FIG. 6B illustrates a graph of fluid pressures present within a probe tool as the probe tool is being extended in accordance with various embodiments.

FIG. 6B illustrates a graph 650 of fluid pressures present within a probe tool as the probe tool is being extended in accordance with various embodiments. Graph 650 includes a vertical axis 651 representing fluid pressure, in thousands of pounds per square inch, which are present within a probe tool and exerted on a piston or other movable portion of the probe tool in order to actuate the probe mechanism of the probe tool in a radial direction outward from the tool body where the probe mechanism is located. Graph 650 also includes a horizontal axis 652 representing time in seconds. Solid graphical line 653 represents a fluid pressure or actuation pressure present within the probe tool over time.

As shown in graph 650, at time T0 a first level of pressure, in some embodiments in a range of 500 to 600 PSI (3.45 and 4.14 MPa), is applied to the movable portion of the probe tool. This initial application of the first pressure allows the resistance to movement of moveable portion of the probe tool resulting from the fluid seal(s) present in the probe tool to be overcome, and in various embodiments extends over the time period indicated by bracket 655. At time T1, a second pressure level, which may be referred to as the actuation pressure, is applied to the movable portion of the probe tool. At this same time (time T1) an actuation timer is started. The actuation timer is set to provide a time window extending from time T1 to time T3, as illustratively represented by bracket 656. The actuation pressure, which in various embodiments is in a range of 2000 to 2500 PSI (13.79 to 17.24 MPA), is maintained within the probe tool as the moveable portion of the probe mechanism extends outward from the tool body.

During this time, the actuation pressure level is monitored. As indicated by solid graphical line 653, at time T2 the actuation pressure rises above a threshold pressure level represented by horizontal dashed line 654. The threshold pressure level is a predetermined value of fluid pressure that occurs when the probe mechanism has made contact with a wall of the wellbore, and thus is blocked from extending further away from the tool body of the probe tool while the actuation pressure continues to be applied to the movable portion of the probe tool. In various embodiments, the threshold pressure level is set at a pressure level that is some percentage, for example ten to 25 percent higher than the pressure level expected to be used as the actuation pressure exerted on the moving portion of the probe tool while the moving parts of the probe tool are in motion in either an extension or a retraction direction. Because the rise in pressure within the probe tool occurred before the expiration of the actuation timer, which would occur at time T3, a determination is made that the probe mechanism has made contact with the wall of the wellbore where the probe tool is located. Further, based on the time expended between T1 and T2, the position of the probe mechanism can be accurately determined based on the knowledge of the amount of fluid provided to the movable portion of the probe tool over the expended time period, and knowledge about the volumes included in the various vessels such as the actuation cavity within the probe tool where the fluid providing the actuation pressures were applied.

Based on a determination that the probe mechanism has made contact with the wall of the wellbore, the actuation pressure being applied to the movable portion of the probe tool may be increased, for example to a fluid pressure level in various embodiments in the range of 2800 to 3200 PSI (19.31 to 22.06 MPa) actuation pressure is used to assure a proper level of seal between the probe mechanism and the wall of the wellbore where the probe tool is located. The third and higher level of actuation pressure is maintained following time T3 while the probe tool and/or other testing apparatus perform tests, measurements, and/or sampling operations on the portion of the wellbore sealed within the probe mechanism. In general, the pressure levels and timeframes illustrated in graph 650 represent an example of successful actuation of the probe mechanism to achieve a hydraulic seal between the probe mechanism and the wall of the wellbore where the probe tool is located.

For FIG. 6B as described above, and for FIGS. 6C and 6D as described below, the pressures and times illustrated in the graphs are provided as non-limiting examples of possible pressures and time frames that may be used in various embodiments. The actual pressures utilized and/or the times utilized may be different from, i.e., higher or lower with regards to pressures, and longer or shorter with respect to times and time periods relative to those illustrated and described with respect to FIGS. 6B, 6C, and 6D. Referring to FIG. 6B as a non-limiting example, in various embodiments the initial pressure applied between time T0 to T1 may be in a range from 50 to 1000 PSI (0.34 to 6.89 MPa), inclusive; the actuation pressure applied between time T1 and T2 may be in a range from 600 to 2000 PSI (4.14 to 13.79 MPa), inclusive; and the sealing pressure applied between time T2 and T3 may be in a range from 1000 to 4000 PSI (6.89 to 17.58 MPa), inclusive. In various non-limiting embodiments, the threshold pressure level as represented by horizontal dashed line 654 may be set, depending on the actuation pressure, in a range from 1000 to 5000 PSI (6.89 to 34.47 MPa), inclusive. In various non-limiting embodiments, the time period represented by bracket 655 may be in a range from 2 to 10 seconds, inclusive; the time period represented by the time between time T1 and T2 may be in a range from 5 to 180 seconds, inclusive; and the time period represented by bracket 656 may be in a range from 25 to 190 seconds, inclusive.

Figure 6C:
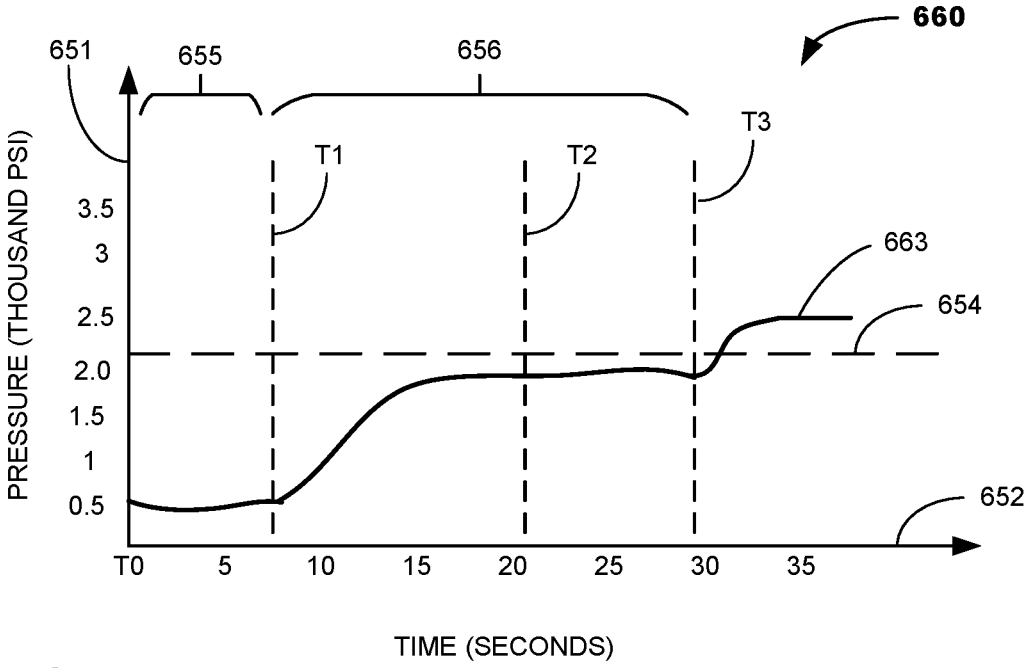
FIG. 6C illustrates a graph of fluid pressures present within a probe tool as the probe tool is being extended in accordance with various embodiments.

FIG. 6C illustrates a graph 660 of fluid pressures present within a probe tool as the probe tool is being extended in accordance with various embodiments. Graph 660 includes a vertical axis 651 representing fluid pressure, in thousands of pounds per square inch, which are present within a probe tool and exerted on a piston or other movable portion of the probe tool in order to actuate the probe mechanism of the probe tool in a radial direction outward from the tool body where the probe mechanism is located. Graph 660 also includes a horizontal axis 652 representing time in seconds.

Solid graphical line 663 represent a fluid pressure or actuation pressure present within the probe tool over time.

As shown in graph 660, at time T0 a first level of pressure, in some embodiments in a range of 500 to 600 PSI (3.45 to 4.14 MPa) is applied to the movable portion of the probe tool. This initial application of the first pressure allows the resistance to movement of the moveable portion of the probe tool resulting from the fluid seal(s) present in the probe tool to be overcome, and in various embodiments extends over the time period indicated by bracket 655. At time T1, and second pressure level, which may be referred to as the actuation pressure, is applied to the movable portion of the probe tool. At this same time (time T1) an actuation timer is started. The actuation timer is set to provide a time window extending from time T1 to time T3, as represented by the time span indicated by bracket 656. The actuation pressure, which in various embodiments is in a range of 2000 to 2500 PSI (13.79 to 17.24 MPA), is maintained within the probe body as the moveable portion of the probe mechanism extends outward from the tool body.

During this time, the actuation pressure level is monitored. As indicated by solid graphical line 663, the fluid pressure level remains below the threshold fluid pressure level represented by horizontal dashed line 654 until time T3. The timespan between T1 and T3, and thus the time set for the expiration of the actuation timer, is calculated as the time required for the moveable portion of the probe tool to reach full extension, and for example be in contact with an end stop mechanism within the probe tool that is designed to prevent the movable portion of the probe mechanism from any further extension. When brought into contact with such an end stop mechanism, the fluid pressure within the probe tool should increase to a level above the threshold pressure level, as indicated by the portion of solid graphical line 663 in the time following time T3. In instances where the fluid pressure levels within the probe tool remain below the threshold pressure level as represented by horizontal dashed line 654 throughout the time period between time T1 and T3, but exceeds the threshold fluid pressure level at or closely following time T3, a determination is made that the probe mechanism was fully extended but did not make contact with the wall of the wellbore where the probe tool is located. This situation may occur when the probe tool is located within the wellbore in an area of the wellbore where the wall of the wellbore is overly large and/or has washed out, and gaining a desired seal between the probe mechanism and the wall of the wellbore in that portion of the wellbore is not possible or not likely to occur.

In instances where monitoring the pressure levels in the probe tool results in a pressure curve such as that shown in graph 660, embodiments may include not performing any testing of the wellbore at that location, and retracting the probe mechanism back into the tool body where the probe tool is located so that the probe tool may be moved to a different location within the wellbore for further attempts at testing using the probe tool.

Figure 6D:
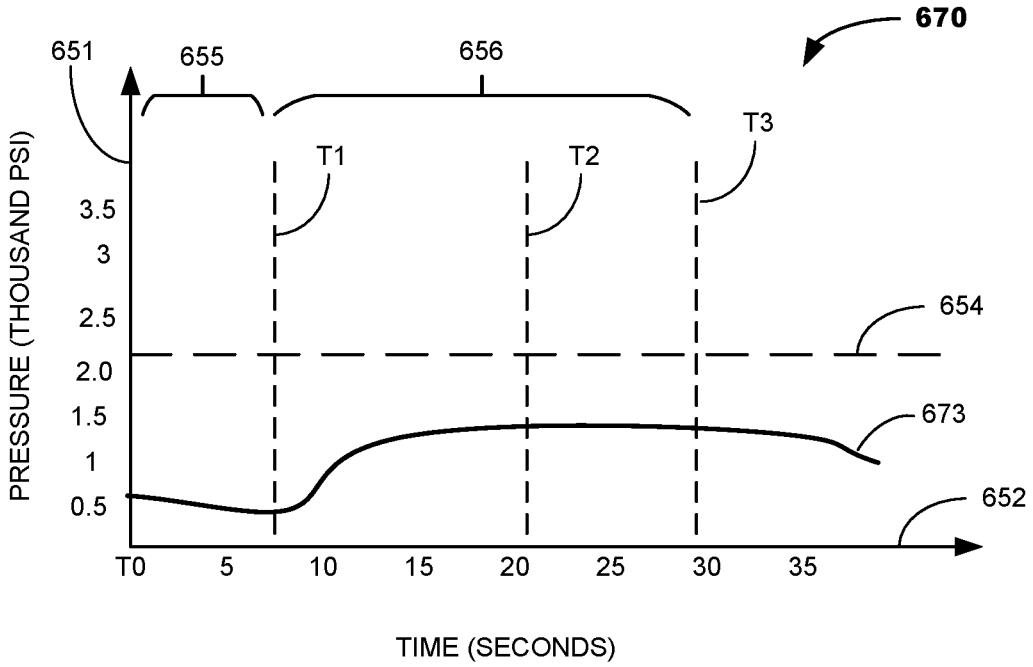
FIG. 6D illustrates a graph of fluid pressures present within a probe tool as the probe tool is being extended in accordance with various embodiments.

FIG. 6D illustrates a graph 670 of fluid pressures present within a probe tool as the probe tool is being extended in accordance with various embodiments. Graph 670 includes a vertical axis 651 representing fluid pressure, in thousands of pounds per square inch, which are present within a probe tool and exerted on a piston or other movable portion of the probe tool in order to actuate the probe mechanism of the probe tool in a radial direction outward from the tool body where the probe mechanism is located. Graph 670 also includes a horizontal axis 652 representing time in seconds. Solid graphical line 673 represent a fluid pressure or actuation pressure present within the probe tool over time.

As shown in graph 670, at time T0 a first level of pressure, in some embodiments in a range of 500 to 600 PSI (3.45 to 4.14 MPa), is applied to the movable portion of the probe tool. This initial application of the first pressure allows the resistance to movement of the moveable portion of the probe tool resulting from the fluid seal(s) present in the probe tool to be overcome, and in various embodiments extends over the time period indicated by bracket 655. At time T1, and second pressure level, which may be referred to as the actuation pressure, is applied to the movable portion of the probe tool. At this same time (time T1) an actuation timer is started. The actuation timer is set to provide a time window extending from time T1 to time T3, as represented by the time span indicated by bracket 656. The actuation pressure, which in various embodiments is in a range of 2000 to 2500 PSI (13.79 to 17.24 MPa), is maintained within the tool body as the moveable portion of the probe mechanism extends outward from the tool body.

During this time, the actuation pressure level is monitored. As indicated by solid graphical line 673, the fluid pressure level remains below the threshold fluid pressure level represented by horizontal dashed line 654 over the timespan between time T2 and T3. The duration of the actuation timer is set so that the actuation timer will expire at time T3, which includes a time period during with the moveable portion of the probe tool could either make contact with a wall of a wellbore where the probe tool is located or extend to the end stop mechanism of the probe tool.

As illustrated by solid graphical line 673, the pressure level within the probe tool remained below the threshold pressure level represented by horizontal dashed line 654 throughout the entire duration of the time period between time T1 and T3, and for some time after time T3 and the expiration of the actuation timer. In instances where monitoring the pressure levels in the probe tool results in a pressure curve such as that shown in graph 670, a determination may be made that there is a hydraulic leak in the probe tool, and therefore adequate hydraulic pressure was not generated within the probe tool to move the probe mechanism to at least a point of contact with a wall of the wellbore where the probe tool is located or to the maximum extend the probe tool is capable of extending to. In instances where monitoring the pressure levels in the probe tool results in a pressure curve such as that shown in graph 670, embodiments may include not performing any testing of the wellbore at that location, generating an error message regarding a status of the probe tool, and attempting to retract the probe mechanism back into the tool body of the probe tool.

By monitoring the fluid pressure levels within the probe tool as illustrated and described above with respect to graphs 650, 660, and 670, various determinations can be made regarding the positioning of the probe mechanism relative to the tool body of the probe tool, whether or not the probe mechanism made a desired level of contact with a wall of a wellbore where the probe tool is located, whether or not the probe mechanism reached a level of full extension without making a desired level of contact with the wall of the wellbore where the probe tool is located, and/or issues with the probe tool such as hydraulic leaks within the system operating the probe tool.

It should be noted that the pressure monitoring of the pressure curves as illustrated in graphs 650, 660, and 670 may also be utilized to monitor and determine a status of the probe mechanism during a retraction of the probe mechanism back to the tool body of the probe tool. For example, solid graphical line 663 of graph 600 in FIG. 6C can confirm that a successful retraction of the probe mechanism has been achieved. In such instances a retraction timer can be initiated at time T1, and set to expire at time T3, when a retraction procedure on the probe mechanism has been initiated at time T0. Monitoring the pressure level over the time interval between T1 and T3 shows that the pressure level is below the threshold pressure level throughout the duration of this time period, and rises above the threshold pressure level represented by dashed horizontal dashed line 654 a short time after the expiration of the retraction timer at time T3. This rise in fluid pressure represents that at the expected time the probe mechanism arrived back at the fully retracted position, in some embodiments engaging a retraction end stop mechanism, resulting in the increase in the fluid pressure following time T3.

On the other hand, if during a retraction of the probe mechanism the monitored pressure curve resembles solid graphical line 653 o graph 650 (FIG. 6B), the rise in pressure above the threshold pressure level represented by dashed horizontal dashed line 654 prior to the expiration of the retraction timer, and thus prior to time T3, may indicate that the probe mechanism has jammed, is stuck, or has caught on some debris or other structure, and is unable to fully retract. In such instances an error message may be generated, and/or some form of action taken, such as initiation an extension of the probe mechanism, in an attempt to free the probe mechanism from any obstructions.

In another alternative instance, the pressure levels present within the probe mechanism during a retraction may be similar to those shown by solid graphical line 673, wherein the level of pressure within the probe tool never exceeds the threshold pressure level indicated by dashed horizontal dashed line 654 any time after the initiation of the retraction process. As described above, this situation may be indicative of a hydraulic leak or other system problem associated with the probe tool, and may result in any combination of the action described above when this condition is detected during an actuation of the probe mechanism.

Figure 7A:
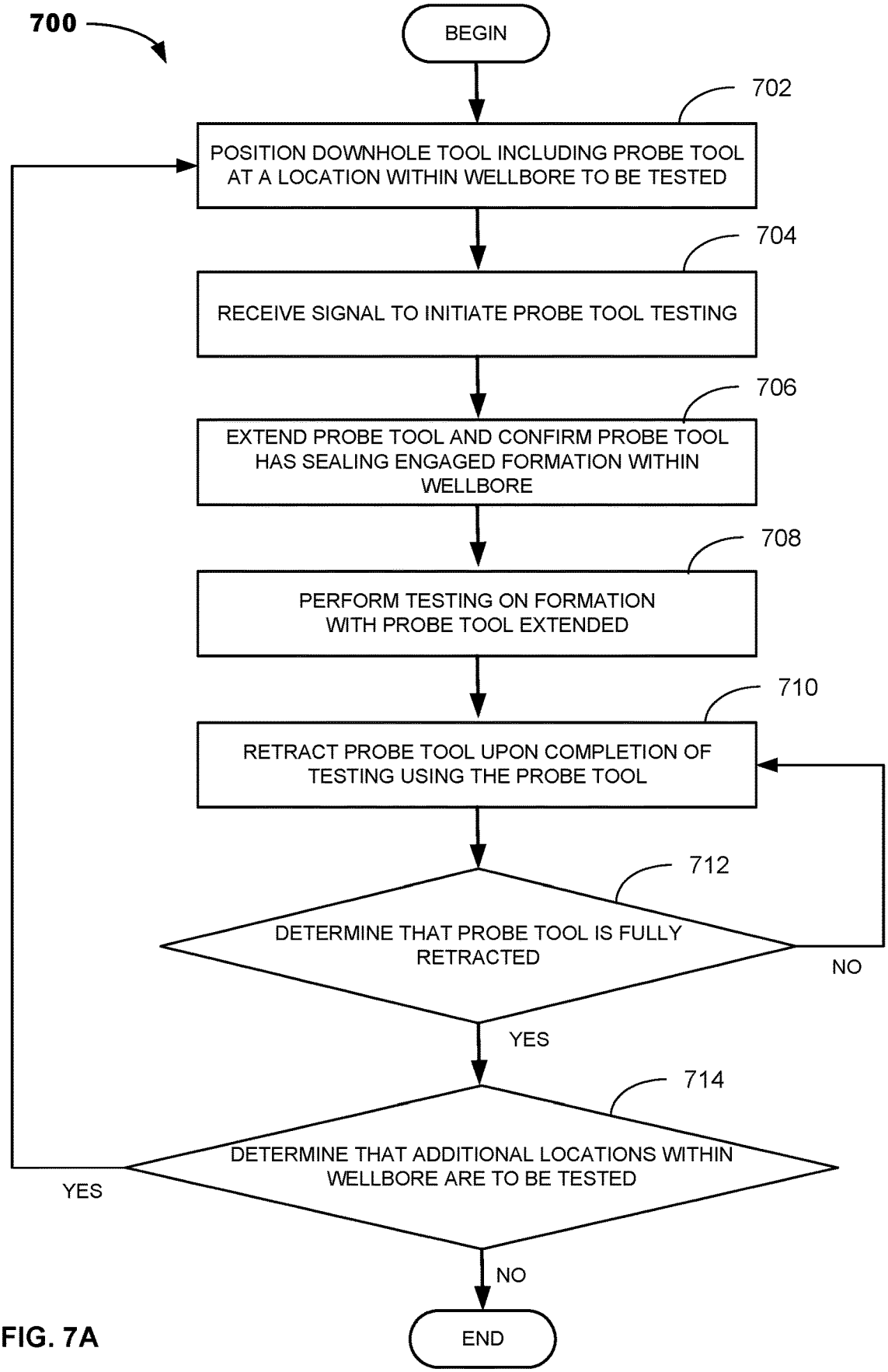
FIG. 7A illustrates a method for performing testing on a wellbore using a probe tool in accordance with various embodiments.

FIG. 7A illustrates a method 700 for performing testing on a wellbore using a probe tool in accordance with various embodiments. Embodiments of method 700 may be performed by a probe tool included as part of a bottom hole assembly configured to perform wellbore drilling operations, such as bottom hole assembly 104 and probe tool 130 as illustrated and described with respect to FIG. 1. Embodiments of method 700 may be performed by a probe tool included as part of a wireline system configured to perform testing within a wellbore, such as wireline system 200 and probe tool 225 as illustrated and described above with respect to FIG. 2.

In various embodiments of method 700 begins by positioning a downhole tool including a probe tool at a position within a wellbore to be tested (block 702). Positioning of the downhole tool may be performed by a well system configured to perform drilling operation on a wellbore or as part of a wireline tool.

After positioning the downhole tool at a location within the wellbore at a location to be tested, embodiments of method 700 include receiving a signal to initiate testing using the probe tool (block 704). In various embodiments, the signal to initiate the testing procedure may be generated by a surface device, such as user interface 150 as illustrated and described above with respect to FIG. 1, and transmitted to the controller included downhole as part of the probe tool, such as controller 450 as illustrated and described above with respect to FIG. 4A.

Referring back to FIG. 7A, embodiments of method 700 include extending the probe tool, and as part of the extension process confirming that that the probe tool has made a sealing engagement with the formation within the wellbore (block 706). Extending the probe tool may include applying an actuation fluid pressure at a known fluid flow rate and a known pressure to a moveable portion of the probe tool to cause the movable portion of the probe tool to extend in a radial direction away from tool body of the probe tool, and starting an actuation timer. Confirmation that the probe tool has made a sealing engagement with the formation may be determined by monitoring the pressure level of the actuation fluid pressure and determining that the actuation fluid pressure exceeded a threshold pressure level within the time limit set by the actuation timer.

Once confirmation that the probe tool has made a sealing engagement with the formation has occurred, embodiments of method 700 include performing one or more tests, measurements, and/or sampling procedures on the portion of the formation that is sealingly engaged with the probe tool (block 708). In various embodiments, tests may include injection fluid tests, fluid flow tests, pressure tests, or other types of formation testing. Measurements may include measuring a pressure present at the formation. Sampling operations may include collecting within the probe tool one or more samples of the formation fluid that are extracted from the formation through passageways extending through the probe mechanism and into the probe tool. In various embodiments, performing the testing on the formation may include transmitting data, in some embodiments in real-time, regarding the testing, test results, measurements, and/or samples collected to one or more devices outside of the probe tool, such as user interface 150 (FIG. 1) located at the surface near the wellbore where the probe tool is located, and/or at some remote location.

Upon completion of the testing performed while the probe tool is extended within the wellbore, embodiments of method 700 include retracting the probe mechanism of the probe tool away from the formation and having the probe mechanism return to a retraction position within the tool body of the probe tool (block 710).

Embodiments of method 700 include confirming that the probe mechanism has been fully retracted (block 712). If the probe mechanism has not been fully retracted, (the "NO" branch extending from block 712), method 700 returns to block 710, where operations to retract the probe mechanism to the fully retracted position continue. When the probe mechanism has been fully retracted, (the "YES" branch extending from block 712), method 700 proceeds to block 714.

At block 714, embodiments of method 700 include determining that one or more additional locations within the wellbore where the probe tool is located is/are to be tested. If a determination is made that one or more additional locations within the wellbore where the probe tool is located are to be tested, (the "YES" branch extending from block 714), method 700 returns to block 702, where the downhole tool including the probe tool is positioned at the next location within the wellbore to be tested, and the additional steps of method 700 are performed at the new location as described above. If a determination is made that no additional locations within the wellbore where the probe tool is located are to be tested, (the "NO" branch extending from block 714), method 700 ends. Ending method 700 may include withdrawing the probe tool from the wellbore where the probe tool is located to the surface above the wellbore, including withdrawal of any samples collected by the probe tool as part of the testing performed on the formation at any of the test locations within the wellbore.

Figure 7B:
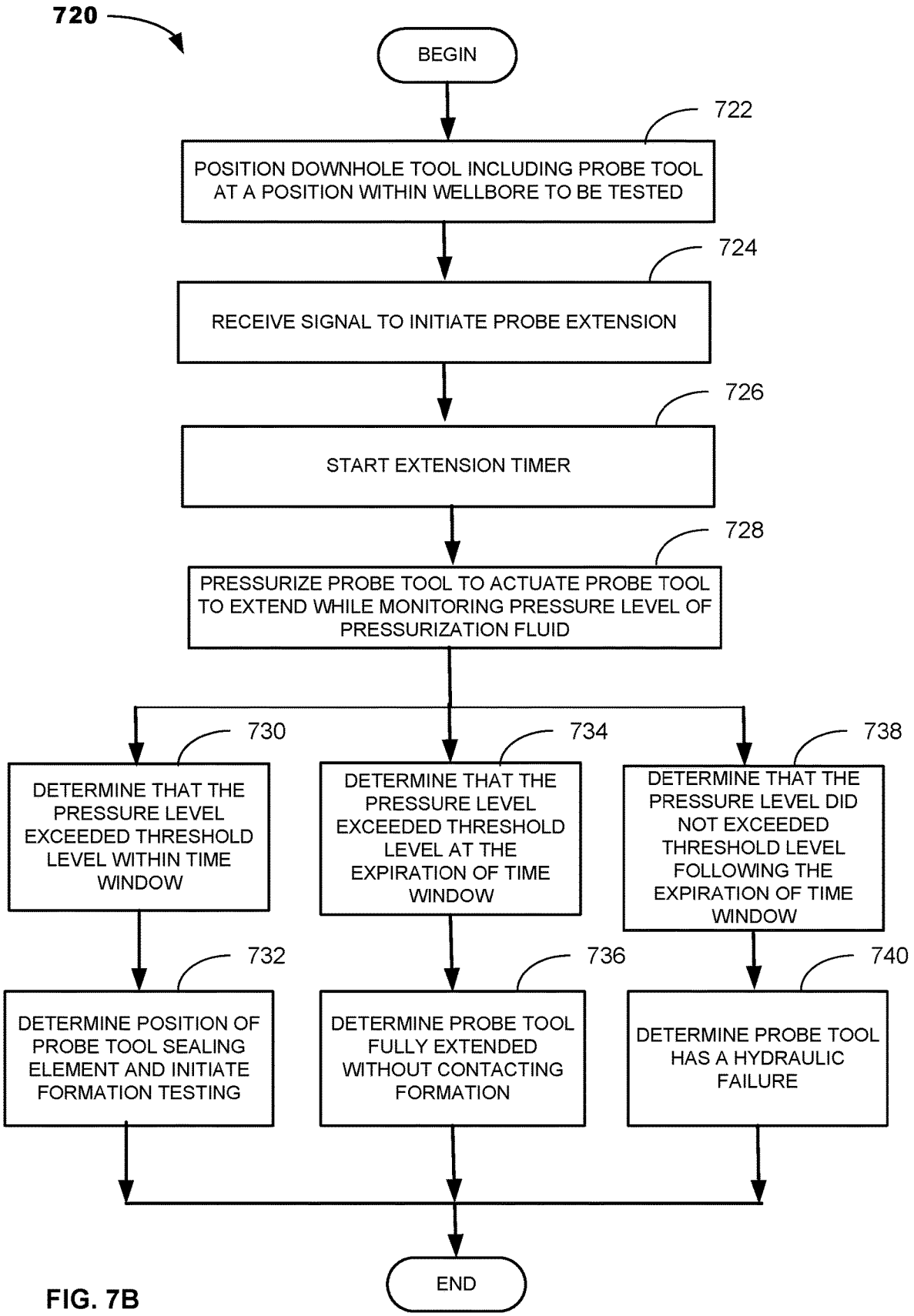
FIG. 7B illustrates a method for performing testing on a wellbore using a probe tool in accordance with various embodiments.

FIG. 7B illustrates a method 720 for performing testing on a wellbore using a probe tool in accordance with various embodiments. Embodiments of method 720 may be performed by a probe tool included as part of a bottom hole assembly configured to perform wellbore drilling operations, such as bottom hole assembly 104 and probe tool 130 as illustrated and described with respect to FIG. 1. Embodiments of method 720 may be performed by a probe tool included as part of a wireline system configured to perform testing within a wellbore, such as wireline system 200 and probe tool 225 as illustrated and described above with respect to FIG. 2. Embodiments of method 720 may be performed in conjunction with performance of one or more steps included in method 700 as illustrated and described above with respect to FIG. 7A and the process of extending the probe mechanism of a probe tool.

In various embodiments, method 720 begins by positioning a downhole tool including a probe tool at a position within a wellbore to be tested (block 722). Positioning of the downhole tool may be performed by a well system configured to perform drilling operation on a wellbore or as part of a wireline tool.

After positioning the downhole tool at a location within the wellbore at a location to be tested, embodiments of method 720 include receiving a signal to initiate an extension of the probe tool (block 724). In various embodiments, the signal to initiate the probe extension may be generated by a surface device, such as user interface 150 as illustrated and described above with respect to FIG. 1, and transmitted to the controller included as part of the probe tool, such as controller 450 as illustrated and described above with respect to FIG. 4A.

After receiving the signal to initiate a probe extension, embodiments of method 720 include starting an extension timer (block 726). In various embodiments, the starting of the extension timer begins upon receipt of the signal to initiate an extension of the probe tool. In alternative embodiments, starting the extension timer begins after an initial period of time when a first level of fluid pressure is applied to the movable portions of the probe tool in order to overcome the initial resistance of movement of the moveable portions of the probe tool due to the seal(s) used within the probe tool. In various embodiments, the extension timer is set to expire after the lapse of an interval of time calculated for the moveable portions of the probe tool to move from the fully retracted position to a fully extended position without having the probe mechanism of the probe tool contact or engage any formation material within the wellbore where the probe tool is located.

After initializing the extension timer, embodiments of method 720 include pressuring the probe tool using a pressurized fluid configured to actuate the probe tool to extend away from the tool body of the probe tool while monitoring a fluid pressure level of the pressurized fluid (block 728). By monitoring the pressurized fluid configured to extend the probe mechanism of the probe tool in conjunction with monitoring the time provided by the extension timer, a plurality of determinations may be made regarding the success or failure of the extension procedure.

For example, in various instances a determination is made that the monitored pressure level of the pressurized fluid exceeded a predetermined threshold pressure level within a time window defined as the time between starting the extension timer and the expiration of the extension timer (e.g., see graph 650, FIG. 6B), represented as block 730 of method 720 in FIG. 7B.

Based on making the determination at block 730, a further determination can be made that the probe mechanism of the probe tool made contact with a wall of the wellbore where the probe tool is located (block 732). Further, in various embodiments the position of the probe mechanism relative to the tool body of the probe tool may be determined based on the amount of time provided by the extension timer between the start of the extension timer and the time when the monitored fluid pressure being provided to the probe tool exceeded the predetermined threshold pressure level. In various embodiments, confirmation that the probe mechanism of the probe tool has successfully engaged the formation with the wellbore where the probe tool is located includes proceeding with one or more testing, measurement, and/or sampling procedures performed on the formation using the probe tool, and ending method 720 with regards to the procedure for extending the probe mechanism.

In an alternative, following the pressurization of the probe tool and monitoring of the pressure levels within the probe tool as described at block 728, a determination is made that the monitored pressure level of the pressurized fluid exceeded a predetermined threshold pressure level only at or just after the time window defined as the time between starting the extension timer and the expiration of the extension timer (e.g., see graph 660, FIG. 6C), represented as block 734 of method 720 in FIG. 7B.

Based on making the determination at block 734, a further determination can be made that the probe mechanism of the probe tool failed to make contact with a wall of the wellbore where the probe tool is located, and extended to the fully extended position of the probe tool (block 736), and ending method 720 with regards to the procedure for extending the probe mechanism.

In another alternative, following the pressurization of the probe tool and monitoring of the pressure levels within the probe tool as described at block 728, a determination is made that the monitored pressure level of the pressurized fluid never exceeded a predetermined threshold pressure level, either during the time window defined as the time between starting the extension timer and the expiration of the extension timer (e.g., see graph 670, FIG. 6D), represented as block 738 of method 720 in FIG. 7B.

Based on making the determination at block 738, a further determination can be made that the there is some type of failure, such as a hydraulic failure, leak, and/or failed seals within fluid system of the probe tool (block 740). As a result, in some embodiments an error message reporting the failure may be generated and output by the probe tool, and ending method 720 with regards to the procedure for extending the probe mechanism.

Figure 7C:
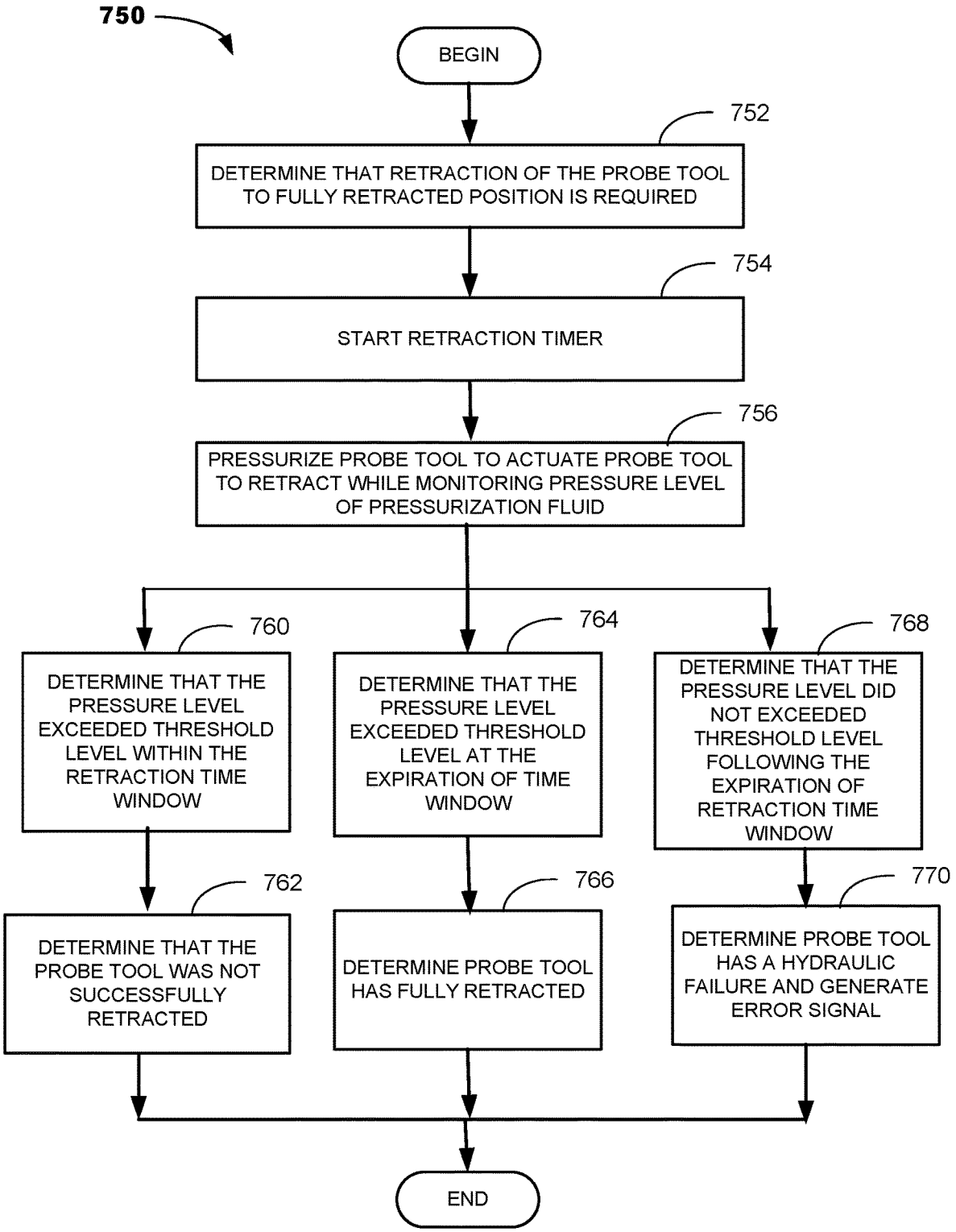
FIG. 7C illustrates a method for performing testing on a wellbore using a probe tool in accordance with various embodiments.

FIG. 7C illustrates a method 750 for performing testing on a wellbore using a probe tool in accordance with various embodiments. Embodiments of method 750 may be performed by a probe tool included as part of a bottom hole assembly configured to perform wellbore drilling operations, such as bottom hole assembly 104 and probe tool 130 as illustrated and described with respect to FIG. 1. Embodiments of method 750 may be performed by a probe tool included as part of a wireline system configured to perform testing within a wellbore, such as wireline system 200 and probe tool 225 as illustrated and described above with respect to FIG. 2. Embodiments of method 750 may be performed in conjunction with performance of one or more steps included in method 700 as illustrated and described above with respect to FIG. 7A and the process of retracting the probe mechanism of a probe tool.

In various embodiments, method 750 begins by determining that retraction of a probe tool to the fully retracted position is required (block 752). In some embodiments, determining that retraction of the probe tool is required may occur following a successful extension of the probe tool to make contact with a wall of a formation within a wellbore where the probe tool is located, and after completion of the testing, measurements, and/or sampling performed while the probe tool is in contact with the formation within the wellbore. In some embodiments, determining that retraction of the probe tool is required may occur following an extension of the probe tool wherein the probe tool extended to the fully extended position without making contact with a wall of the wellbore where the probe tool is located. In some embodiments, determining that retraction of the probe tool is required may occur following an failed attempt to extend the probe tool, for example due to a failure, such as a mechanical and/or a hydraulic system failure within the probe tool.

After making a determination that a retraction of the probe tool is required, embodiments of method 750 include starting a retraction timer (block 754). In various embodiments, the starting of the retraction timer begins immediately upon making the determination to retract the probe tool. In alternative embodiments, starting the retraction timer begins after an initial period of time when a first level of fluid pressure is applied to the movable portions of the probe tool in order to overcome the initial resistance of movement of the moveable portions of the probe tool due to the seal(s) used within the probe tool. In various embodiments, the retraction timer is set to expire after the lapse of an interval of time calculated for the moveable portions of the probe tool to move from the fully extended position to a fully retracted position.

After initializing the retraction timer, embodiments of method 750 include pressuring the probe tool using a pressurized fluid configured to actuate the probe tool to retract in a direction toward the tool body of the probe tool while monitoring a fluid pressure level of the pressurized fluid (block 756). By monitoring the pressurized fluid configured to retract the probe mechanism of the probe tool in conjunction with monitoring the time provided by the retraction timer, a plurality of determinations may be made regarding the success or failure of the retraction procedure.

For example, in various instances a determination is made that the monitored pressure level of the pressurized fluid exceeded a predetermined threshold pressure level within a time window defined as the time between starting the retraction timer and the expiration of the retraction timer (e.g., see graph 650, FIG. 6B), represented as block 760 of method 750 in FIG. 7C.

Based on making the determination at block 760, a further determination can be made that the probe mechanism of the probe tool failed to fully retract (block 762). This situation may occur for example wen the probe tool jams or is stuck on debris or other structure object prior to reaching the fully retracted position. In various embodiments, the determination that the probe tool failed to fully retract further comprises generating and outputting from the probe tool and error message, and ending method 750.

In an alternative, following the pressurization of the probe tool and monitoring of the pressure levels within the probe tool as described at block 756, a determination is made that the monitored pressure level of the pressurized fluid exceeded a predetermined threshold pressure level only at or just after the time window defined as the time between starting the retraction timer and the expiration of the retraction timer (e.g., see graph 660, FIG. 6C), represented as block 764 of method 750 in FIG. 7C.

Based on making the determination at block 764, a further determination can be made that the probe mechanism was successfully retracted to the fully retracted position (block 766). In various embodiments, the determination that the probe tool successfully retracted to fully retract further comprises generating an outputting from the probe tool indicative that the probe tool is fully retracted, and ending method 750.

In another alternative, following the pressurization of the probe tool and monitoring of the pressure levels within the probe tool as described at block 756, a determination is made that the monitored pressure level of the pressurized fluid never exceeded a predetermined threshold pressure level, either during the time window defined as the time between starting the retraction timer and the expiration of the retraction timer (e.g., see graph 670, FIG. 6D), represented as block 768 of method 750 in FIG. 7C.

Based on making the determination at block 768, a further determination can be made that the there is some type of failure, such as a hydraulic failure, leak, and/or failed seals within fluid system of the probe tool (block 740). As a result, in some embodiments an error message reporting the failure may be generated and output by the probe tool, and ending method 750 with regards to the procedure for retracting the probe mechanism.

Figure 8:
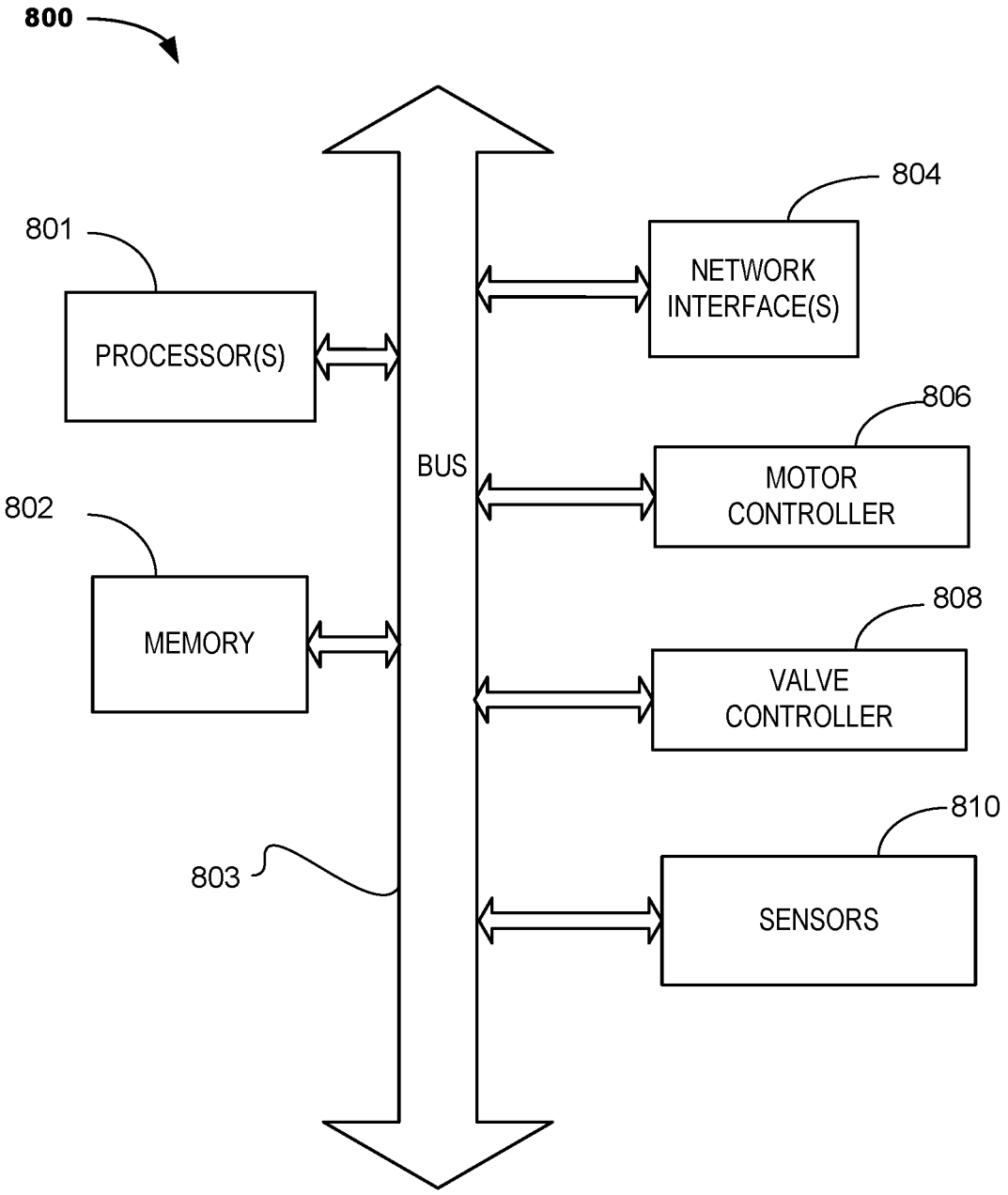
FIG. 8 illustrates a block diagram of an example computer system that may be employed to practice the concepts, methods, and techniques disclosed herein, and variations thereof.

FIG. 8 illustrates a block diagram of an example computer system 800 that may be employed to practice the concepts, methods, and techniques disclosed herein, and variations thereof. The computing system 800 includes a plurality of components of the system that are in electrical communication with each other, in some examples using a bus 803. The computing system 800 may include any suitable computer, controller, or data processing apparatus capable of being programmed to carry out the methods and apparatus as further described herein.

Embodiments of computing system 800 may be a general-purpose computer, and include a one or more processor(s) 801 (possibly including multiple processors, multiple cores, multiple nodes, and/or implementing multi-threading, etc.), and memory 802. The memory 802 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the possible realizations of non-transitory machine-readable media.

Embodiments of computer system 800 also include network interface 804 (e.g., a Fiber Channel interface, an Ethernet interface, an internet small computer system interface, SONET interface, wireless interface, etc.). Network interface 804 may be configured to provide communication between computer system 800 and one or more other devices such as the computer system of user interface 150 (FIG. 1) located outside of the probe tool where computer system 800 is located. For example, network interface 804 may be communicatively coupled to a computer device configured to send the initial signal to the probe tool indicating that the probe tool is in position to perform a testing procedure on a formation within a wellbore. Network interface 804 may be configured to transmits data and other information to one or more other computer devices located outside of the probe tool where computer system 800 is located. For example, network interface 804 may be configured to transmit data, including test results and/or measurements data collected by the probe tool from engaging with a formation within a wellbore. In various embodiments, network interface 804 is configured to transmit to a computer device located outside of the probe tool where computer system 800 is located information indicating that a testing operation using the probe tool has been completed, and that the probe tool is fully retracted, in order to allow the downhole tool that includes the probe tool to be moved within the wellbore.

Embodiments of computer system 800 include motor controller 806. Motor controller may be configured to control a motor, such as motor 412 (FIG. 4A, 4B) that is coupled to a pump, such as pump 411 (FIG. 4A, 4B). Control of the motor by the motor controller 806 results in a known quantity of fluid being provide by the pump coupled to the moveable portion of the probe tool, both on an actuation to extend and an actuation to retract the probe mechanism of probe tool. By knowing the quantity of fluid provided to the movable portion of the probe tool, in conjunction with monitoring the pressure of the provided fluid using one or more of sensors 810 of computer system 800, the position of the probe mechanism can be accurately determined, along with making determinations about whether the probe mechanism has successfully engaged with a wall of a formation with the wellbore where the probe tool is located.

Embodiments of computer system 800 further include valve controller 808. Value controller includes one or more fluid valves, check valve, accumulators, and/or other fluid flow control devices that allow for the desired control of the flow and the pressure of the fluid that is applied to the probe tool in order to control the operation of the probe tool, both with respect to extending and retracting the probe mechanism of the probe tool, and assuring a proper sealing connection between the probe mechanism and the formation within the wellbore that is to be tested.

Sensor 810 may include any type of sensors needed to provide inputs to the computer system 800 to allow for the proper operation of the probe tool that computer system 800 is coupled to and controlling. For example, one of more of sensors 810 may be configured to provide a signal output that is indicative of the rotational speed and/or the number of rotations or partial rotations of the motor coupled to the pump and controlled by motor controller 806. Sensors 810 may be configured to monitor a fluid pressure and/or a quantity of fluid flow being provided to the movable portions of the probe tool during extensions of the movable portions, retraction of the movable portions, and/or retention of the movable portion of the probe tool, including retention when the probe mechanism is in contact with a formation within a wellbore and retention of the movable portions of the probe tool when the probe mechanism is in the fully retracted position.

In various embodiments, the one or more processor(s) 801 may be configured to generate control signals to control the different operations that may be performed for operating the probe tool within a wellbore. For example, processor(s) 801 may generate control signals that may be used to control the operations of motor controller 806 and valve controller 808, in various embodiment based at least in part on one or more signals generated by and received from sensors 810. In various embodiments, the one or more processor(s) 801 are configured to may any of the determinations regarding the position of the probe tool and/or a status of the probe tool as described above, for example with respect to the determinations made as part of the methods 700, 720, and/or 750 as described above.

Any one of the previously described functionalities may be partially (or entirely) implemented in hardware, software, and/or firmware on the processor(s) 801. For example, the functionality may be implemented with an application specific integrated circuit, in logic implemented in the processor (s) 801, in a co-processor on a peripheral device or card, etc.

With respect to computing system 800, basic features here may easily be substituted for improved hardware or firmware arrangements as they are developed. In some examples, memory 802 includes non-transient and/or non-volatile memory devices, and can be a hard disk or other types of computer readable media which can store data that are accessible by a computer, such as magnetic cassettes, flash memory cards, solid state memory devices, digital versatile disks (DVDs), cartridges, RAM, ROM, a cable containing a bit stream, and hybrids thereof.

It will be understood that one or more blocks of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus. As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine. While depicted as a computing system 1200 or as a general purpose computer, some embodiments can be any type of device or apparatus to perform operations described herein.

While the aspects of the disclosure are described with reference to various implementations and exploitations, it will be understood that these aspects are illustrative and that the scope of the claims is not limited to them. In general, techniques for automatically pressure testing frac iron described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Example embodiments include the following.

Embodiment 1. A method comprising: positioning a downhole tool including a probe tool at a location within a wellbore; initiating testing using the probe tool including starting an extension timer and actuating the probe tool to extend a probe mechanism to engage a wall of the wellbore by applying an actuation fluid pressure at a known fluid flow rate and a known pressure to a moveable portion of the probe tool; and determining that the probe mechanism has made contact with the wall of the wellbore by monitoring a pressure level of the actuation fluid pressure and determining that the actuation fluid pressure exceeded a threshold pressure level within a time limit set by the extension timer.

Embodiment 2. The method of embodiment 1, wherein initiating the testing using the probe tool comprises initiating the testing in response to receiving a signal at the probe tool to initiate testing of the wellbore using the probe tool.

Embodiment 3. The method of embodiments 1 or 2, wherein the time limit set by the extension timer is a calculated as a time period required for the probe mechanism to extend from a fully retracted position to a fully extended position without having made contact with any portion of the wellbore and while having the actuation fluid pressure at the known fluid flow rate and the known pressure applied to the movable portion of the probe tool.

Embodiment 4. The method of any one of embodiments 1-3, wherein applying the actuation fluid pressure at a known fluid flow rate and a known pressure includes generating the actuation fluid pressure using a positive displacement pump.

Embodiment 5. The method of any one of embodiments 1-4, further comprising operating the positive displacement pump by controlling a rotational speed of a motor coupled to the positive displacement pump.

Embodiment 6. The method of any one of embodiments 1-5, wherein the actuation fluid pressure is in a range from 600 to 2500 pounds per square inch (4.1369 to 17.2369 MPa), inclusive.

Embodiment 7. The method of any one of embodiments 1-6, wherein the movable portion of the probe tool includes a piston positioned within a piston sleeve and mechanically coupled to the probe mechanism.

Embodiment 8. The method of any one of embodiments 1-7, wherein after determining that the probe mechanism has made contact with the wall of the wellbore, increasing the actuation fluid pressure being applied to a moveable portion of the probe tool to a fluid pressure level greater than the known pressure to form a hydraulic seal between a contact surface of the probe mechanism and the wall of the wellbore.

Embedment 9. The method of embodiment 8, wherein while applying the increased actuation fluid pressure to the movable portion of the probe tool, conducting one or more tests on a portion of a formation within the wellbore that is engaged within the contact surface.

Embodiment 10. The method of any one of embodiments 1-9, wherein following actuation of the probe tool to extend the probe mechanism, the method further comprising: determining that probe mechanism is to be retracted; initiating a retraction timer and actuating the probe tool to retract the probe by applying the actuation fluid pressure at a known fluid flow rate and a known pressure to the moveable portion of the probe tool; and determining that the probe mechanism has retracted to a fully retracted position by monitoring a pressure level of the actuation fluid pressure and determining that the actuation fluid pressure exceeded a threshold pressure level within a time limit set by the retraction timer.

Embodiment 11. The method of any one of embodiments 1-10, wherein the tool body of the probe tool has a diameter in cross-section in a range from 4.75 and 9.50 inches (12.07 cm to 24.13 centimetres), inclusive, and is configured to operate in a wellbore having a diameter in cross-section in a range from 5.875 to 15.0 inches (14.93 to 38.10 centimeters), inclusive.

Embodiment 12. A system comprising: a downhole tool including a probe tool having a movable portion including a probe mechanism, the probe tool configured to extend the probe mechanism outward from a tool body of the probe tool to allow the probe mechanism to engage a wall of a wellbore where the downhole tool is located; the probe tool further comprising a motor coupled to a pump, the motor configured to operate the pump to provide an actuation fluid pressure at a known fluid flow rate and a known pressure to a moveable portion of the probe tool; and a processor configured to: receive a signal to initiate testing of the wellbore using the probe tool while the probe tool is positioned within the wellbore; start an extension timer; control operation of a motor coupled to a pump to extend the probe mechanism by applying the actuation fluid pressure at the known fluid flow rate and the known pressure to the moveable portion of the probe tool; receive a signal from a pressure sensor indicative of the actuation fluid pressure as the actuation fluid pressure is applied to the movable portion of the probe tool; and determine that the probe mechanism has made contact with the wall of the wellbore by determining that the actuation fluid pressure exceeded a threshold pressure level within a time limit set by the extension timer.

Embodiment 13. The system of embodiment 12, wherein the time limit set by the extension timer is a calculated as a time period required for the probe mechanism to extend from a fully retracted position to a fully extended position without having made contact with any portion of the wellbore and while having the actuation fluid pressure at the known fluid flow rate and the known pressure applied to the movable portion of the probe tool.

Embodiment 14. The system of embodiments 12 or 13, wherein the pump is a positive displacement pump.

Embodiment 15. The system of any one of embodiments 12-14, wherein the tool body of the probe tool has a diameter in cross-section in a range from 4.75 and 9.50 inches (12.07 cm to 24.13 centimetres), inclusive, and is configured to operate in a wellbore having a diameter in cross-section in a range from 5.875 to 15.0 inches (14.93 to 38.10 centimeters), inclusive.

Embodiment 16. The system of any one of embodiments 12-15, wherein the processor is further configured to: determine that probe mechanism is to be retracted; initiate a retraction timer and actuating the probe tool to retract the probe by controlling the operation of a motor coupled to a pump to retract the probe mechanism by applying the actuation fluid pressure at the known fluid flow rate and the known pressure to the moveable portion of the probe tool; and determine that the probe mechanism has retracted to a fully retracted position by monitoring a pressure level of the actuation fluid pressure and determining that the actuation fluid pressure exceeded a threshold pressure level within a time limit set by the retraction timer.

Embodiment 17. The system of any one of embodiments 12-16, wherein after determining that the probe mechanism has made contact with the wall of the wellbore, the processor is further configured to: control the operation of the motor coupled to the pump to increase the actuation fluid pressure being applied to a moveable portion of the probe tool to a fluid pressure level greater than the known pressure to form a hydraulic seal between a contact surface of the probe mechanism and the wall of the wellbore.

Embodiment 18. The system of any one of embodiments 12-17, further comprising: a test apparatus coupled to a passageway extending through the probe mechanism, wherein while applying the increased actuation fluid pressure to the movable portion of the probe tool, the test apparatus is configured to conduct one or more tests on a portion of a formation within the wellbore that is engaged within the contact surface of the probe mechanism.

Embodiment 19. A non-transitory machine-readable storage medium storing instructions thereon, wherein the instructions comprise program code executable by a processor to cause the processor to: receive a signal to initiate testing of a wellbore using a probe tool positioned within the wellbore; start an extension timer; control operation of a motor coupled to a pump to actuate the probe tool to extend a probe mechanism to engage a wall of the wellbore by applying an actuation fluid pressure at a known fluid flow rate and a known pressure to a moveable portion of the probe tool; receive a signal from a pressure sensor indicative of the actuation fluid pressure as the actuation fluid pressure is applied to the movable portion of the probe tool; and determine that the probe mechanism has made contact with the wall of the wellbore by determining that the actuation fluid pressure exceeded a threshold pressure level within a time limit set by the extension timer.

Embodiment 20. The non-transitory machine-readable storage medium of embodiment 19, wherein the instructions further comprise program code executable by the processor to cause the processor to: determine that probe mechanism is to be retracted; initiate a retraction timer and control the operation of the motor coupled to the pump to actuate the probe tool to retract the probe mechanism by applying the actuation fluid pressure at a known fluid flow rate and a known pressure to the moveable portion of the probe tool; receive a signal from a pressure sensor indicative of the actuation fluid pressure as the actuation fluid pressure is applied to the movable portion of the probe tool; and determine that the probe mechanism has retracted to a fully retracted position by monitoring a pressure level of the actuation fluid pressure and determining that the actuation fluid pressure exceeded a threshold pressure level within a time limit set by the retraction timer.

What is claimed is:

1. A method comprising:

positioning a downhole tool including a probe tool at a location within a wellbore;

initiating testing using the probe tool including starting an extension timer and actuating the probe tool to extend a probe mechanism to engage a wall of the wellbore by applying an actuation fluid pressure at a known fluid flow rate and a known pressure to a moveable portion of the probe tool; and determining that the probe mechanism has made contact with the wall of the wellbore by monitoring a pressure level of the actuation fluid pressure and determining that the actuation fluid pressure exceeded a threshold pressure level within a time limit set by the extension timer.

2. The method of claim 1, wherein initiating the testing using the probe tool comprises initiating the testing in response to receiving a signal at the probe tool to initiate testing of the wellbore using the probe tool.

3. The method of claim 1, wherein the time limit set by the extension timer is a calculated as a time period required for the probe mechanism to extend from a fully retracted position to a fully extended position without having made contact with any portion of the wellbore and while having the actuation fluid pressure at the known fluid flow rate and the known pressure applied to the movable portion of the probe tool.

4. The method of claim 1, wherein applying the actuation fluid pressure at a known fluid flow rate and a known pressure includes generating the actuation fluid pressure using a positive displacement pump.

5. The method of claim 4, further comprising operating the positive displacement pump by controlling a rotational speed of a motor coupled to the positive displacement pump.

6. The method of claim 1, wherein the actuation fluid pressure is in a range from 600 to 2500 pounds per square inch (4.1369 to 17.2369 MPa), inclusive.

7. The method of claim 1, wherein the movable portion of the probe tool includes a piston positioned within a piston sleeve and mechanically coupled to the probe mechanism.

8. The method of claim 1, wherein after determining that the probe mechanism has made contact with the wall of the wellbore, increasing the actuation fluid pressure being applied to a moveable portion of the probe tool to a fluid pressure level greater than the known pressure to form a hydraulic seal between a contact surface of the probe mechanism and the wall of the wellbore.

9. The method of claim 8, wherein while applying the increased actuation fluid pressure to the movable portion of the probe tool, conducting one or more tests on a portion of a formation within the wellbore that is engaged within the contact surface.

10. The method of claim 1, wherein following actuation of the probe tool to extend the probe mechanism, the method further comprising:

determining that probe mechanism is to be retracted;

initiating a retraction timer and actuating the probe tool to retract the probe by applying the actuation fluid pressure at a known fluid flow rate and a known pressure to the moveable portion of the probe tool; and determining that the probe mechanism has retracted to a fully retracted position by monitoring a pressure level of the actuation fluid pressure and determining that the actuation fluid pressure exceeded a threshold pressure level within a time limit set by the retraction timer.

11. The method of claim 1, wherein the tool body of the probe tool has a diameter in cross-section in a range from 4.75 and 9.50 inches (12.07 cm to 24.13 centimetres), inclusive, and is configured to operate in a wellbore having a diameter in cross-section in a range from 5.875 to 15.0 inches (14.93 to 38.10 centimeters), inclusive.

12. A system comprising:

a downhole tool including a probe tool having a movable portion including a probe mechanism, the probe tool configured to extend the probe mechanism outward from a tool body of the probe tool to allow the probe mechanism to engage a wall of a wellbore where the downhole tool is located;

the probe tool further comprising a motor coupled to a pump, the motor configured to operate the pump to provide an actuation fluid pressure at a known fluid flow rate and a known pressure to a moveable portion of the probe tool; and a processor configured to:

receive a signal to initiate testing of the wellbore using the probe tool while the probe tool is positioned within the wellbore;

start an extension timer;

control operation of a motor coupled to a pump to extend the probe mechanism by applying the actuation fluid pressure at the known fluid flow rate and the known pressure to the moveable portion of the probe tool;

receive a signal from a pressure sensor indicative of the actuation fluid pressure as the actuation fluid pressure is applied to the movable portion of the probe tool; and determine that the probe mechanism has made contact with the wall of the wellbore by determining that the actuation fluid pressure exceeded a threshold pressure level within a time limit set by the extension timer.

13. The system of claim 12, wherein the time limit set by the extension timer is a calculated as a time period required for the probe mechanism to extend from a fully retracted position to a fully extended position without having made contact with any portion of the wellbore and while having the actuation fluid pressure at the known fluid flow rate and the known pressure applied to the movable portion of the probe tool.

14. The system of claim 12, wherein the pump is a positive displacement pump.

15. The system of claim 12, wherein the tool body of the probe tool has a diameter in cross-section in a range from 4.75 and 9.50 inches (12.07 cm to 24.13 centimetres), inclusive, and is configured to operate in a wellbore having a diameter in cross-section in a range from 5.875 to 15.0 inches (14.93 to 38.10 centimeters), inclusive.

16. The system of claim 12, wherein the processor is further configured to:

determine that probe mechanism is to be retracted;

initiate a retraction timer and actuating the probe tool to retract the probe by controlling the operation of a motor coupled to a pump to retract the probe mechanism by applying the actuation fluid pressure at the known fluid flow rate and the known pressure to the moveable portion of the probe tool; and determine that the probe mechanism has retracted to a fully retracted position by monitoring a pressure level of the actuation fluid pressure and determining that the actuation fluid pressure exceeded a threshold pressure level within a time limit set by the retraction timer.

17. The system of claim 12, wherein after determining that the probe mechanism has made contact with the wall of the wellbore, the processor is further configured to:

control the operation of the motor coupled to the pump to increase the actuation fluid pressure being applied to a moveable portion of the probe tool to a fluid pressure level greater than the known pressure to form a hydraulic seal between a contact surface of the probe mechanism and the wall of the wellbore.

18. The system of claim 17, further comprising:

a test apparatus coupled to a passageway extending through the probe mechanism, wherein while applying the increased actuation fluid pressure to the movable portion of the probe tool, the test apparatus is configured to conduct one or more tests on a portion of a formation within the wellbore that is engaged within the contact surface of the probe mechanism.

19. A non-transitory machine-readable storage medium storing instructions thereon, wherein the instructions comprise program code executable by a processor to cause the processor to:

receive a signal to initiate testing of a wellbore using a probe tool positioned within the wellbore;

start an extension timer;

control operation of a motor coupled to a pump to actuate the probe tool to extend a probe mechanism to engage a wall of the wellbore by applying an actuation fluid pressure at a known fluid flow rate and a known pressure to a moveable portion of the probe tool;

receive a signal from a pressure sensor indicative of the actuation fluid pressure as the actuation fluid pressure is applied to the movable portion of the probe tool; and determine that the probe mechanism has made contact with the wall of the wellbore by determining that the actuation fluid pressure exceeded a threshold pressure level within a time limit set by the extension timer.

20. The non-transitory machine-readable storage medium of claim 19, wherein the instructions further comprise program code executable by the processor to cause the processor to:

determine that probe mechanism is to be retracted;

initiate a retraction timer and control the operation of the motor coupled to the pump to actuate the probe tool to retract the probe mechanism by applying the actuation fluid pressure at a known fluid flow rate and a known pressure to the moveable portion of the probe tool;

receive a signal from a pressure sensor indicative of the actuation fluid pressure as the actuation fluid pressure is applied to the movable portion of the probe tool; and determine that the probe mechanism has retracted to a fully retracted position by monitoring a pressure level of the actuation fluid pressure and determining that the actuation fluid pressure exceeded a threshold pressure level within a time limit set by the retraction timer.

* * * * *